US010760552B2

(12) United States Patent
Slough et al.

(10) Patent No.: US 10,760,552 B2
(45) **Date of Patent: *Sep. 1, 2020**

(54) APPARATUS, SYSTEMS AND METHODS FOR ESTABLISHING PLASMA AND USING PLASMA IN A ROTATING MAGNETIC FIELD

(71) Applicant: MSNW LLC, Redmond, WA (US)

(72) Inventors: John Thomas Slough, Bellevue, WA (US); David Edwin Kirtley, Seattle, WA (US)

(73) Assignee: MSNW LLC, Redmond, WA (US)

( * ) Notice: Subject to any disclaimer, the term of this patent is extended or adjusted under 35 U.S.C. 154(b) by 782 days.

This patent is subject to a terminal disclaimer.

(21) Appl. No.: 14/867,997

(22) Filed: Sep. 28, 2015

(65) Prior Publication Data

US 2016/0115946 A1 Apr. 28, 2016

Related U.S. Application Data

(63) Continuation of application No. 13/206,381, filed on Aug. 9, 2011, now Pat. No. 9,145,874.

(Continued)

(51) Int. Cl.
*F03H 1/00* (2006.01)

(52) U.S. Cl.
CPC ..... *F03H 1/0081* (2013.01); *F03H 1/00* (2013.01); *F03H 1/0087* (2013.01)

(58) Field of Classification Search
CPC ..... F03H 1/00–0093
See application file for complete search history.

(56) References Cited

U.S. PATENT DOCUMENTS 3,113,427 A 12/1963 Meyer
3,128,595 A * 4/1964 Meyer ..... B64G 1/405 60/202

(Continued)

FOREIGN PATENT DOCUMENTS

GB 738511 10/1955
WO 2011034466 A2 3/2001

OTHER PUBLICATIONS

Slough "Magnetically Accelerated Plasmoid (MAP) Thruster—Initial Results and Future Plans" (Year: 2007).*

(Continued)

*Primary Examiner* — Gerald L Sung
*Assistant Examiner* — William L Breazeal

(57) ABSTRACT

Systems and methods establish plasma in a rotating magnetic field. An exemplary embodiment is a plasma thruster that establishes a first transverse magnetic field with respect to a system axis of a plasma propulsion system; establishes a second transverse magnetic field oriented orthogonally to the first transverse magnetic field, wherein the second transverse magnetic field is out of phase with the first transverse magnetic field; and establishes a magnetic field aligned with the system axis using a plurality of magnet elements oriented along the system axis. A plasma containment portion defines an interior region, wherein an interior region of a plasma containment portion accommodates a plasma that is established by a rotating magnetic field component that is cooperatively established by the first transverse magnetic field and the second transverse magnetic field, and wherein the plasma is accelerated out of the plasma containment portion by magnetic forces to generate a propulsion force.

16 Claims, 12 Drawing Sheets

Related U.S. Application Data

(60) Provisional application No. 61/372,001, filed on Aug. 9, 2010.

(56) References Cited

U.S. PATENT DOCUMENTS 3,935,503 A * 1/1976 Ress ..... H01F 7/202 315/111.61
2010/0192538 A1* 8/2010 Boren ..... H02K 44/02 60/202

OTHER PUBLICATIONS

Slough "Magnetically Accelerated Plasmoid (MAP) Propulsion", Jul. 2006, 42nd AIAA/ASME/SAE/ASEE Joint Propulsion Conference & Exhibit. http://arc.aiaa.org/doi/pdf/10.2514/6.2006-4654
Slough, "Multi-Megawatt Propulsion Based on a Compact Toroid Thruster", 2005, 29th International Electric Propulsion Conference, Princeton University. http://erps.spacegrant.org/uploads/images/images/iepc_articledownload_1988-2007/2005index/296.pdf.
Slough "Magnetically Accelerated Plasmoid (MAP) Thruster—Initial Results and Future Plans" Presented at the 30th International Electric Propulsion Conference, Florence, Italy Sep. 17-20, 2007, http://www.researchgate.net/publication/237702417_Magnetically_Accelerated_Plasmoid_(MAP)_Thruster_Initial_Results_and_Future_Plans.
Slough et al, "Pulsed Plasmoid Propulsion: The ELF Thruster", Proceedings of the 31st International Electronic Propulsion Conference, IEPC-2009-265, Sep. 20-24, 2009, pp. 1-24, XP008147097, University of Michigan, Ann Arbor, Michigan, USA.
Brown et al, "Air Force Research Laboratory High Power Electronic Propulsion Technology Development", Aerospace Conference 2010 IEEE, Mar. 6, 2010, pp. 1-9, XP031657401, Piscataway , New Jersey, USA.
Fukuda et al, "A Compact Disk Type Plasma Propulsion System with Modulated Magnetic Field for Nanoscale Space Vehicles", American Institute of Physics Conference Proceedings, Jan. 1, 2008, pp. 923-928, XP55015870, DOI: 10.1063/1.3076609.

* cited by examiner

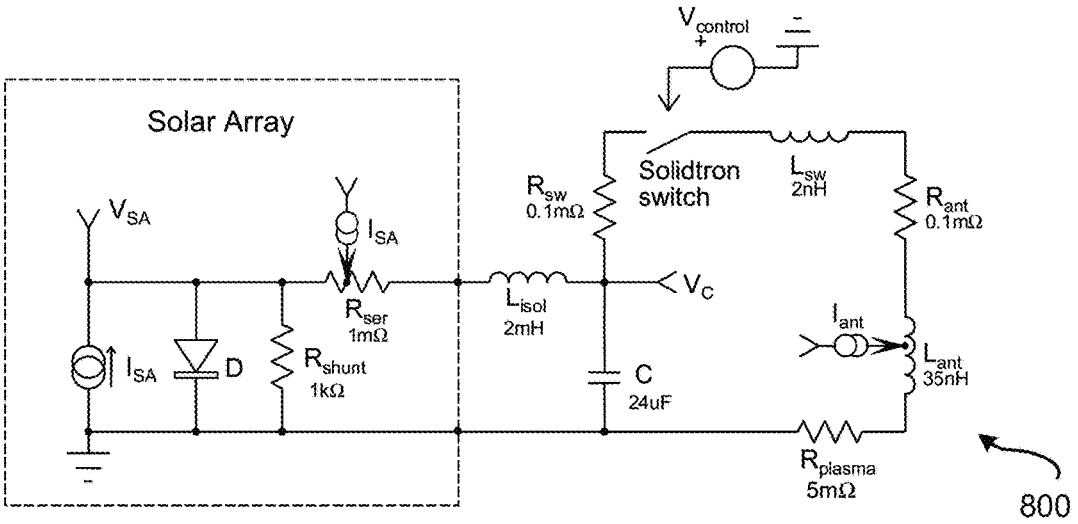
FIG. 8
FIG. 9
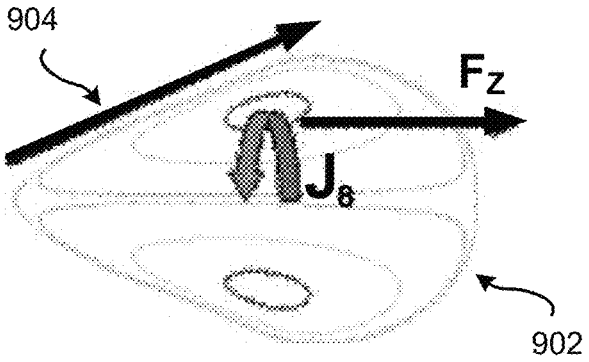
FIG. 10
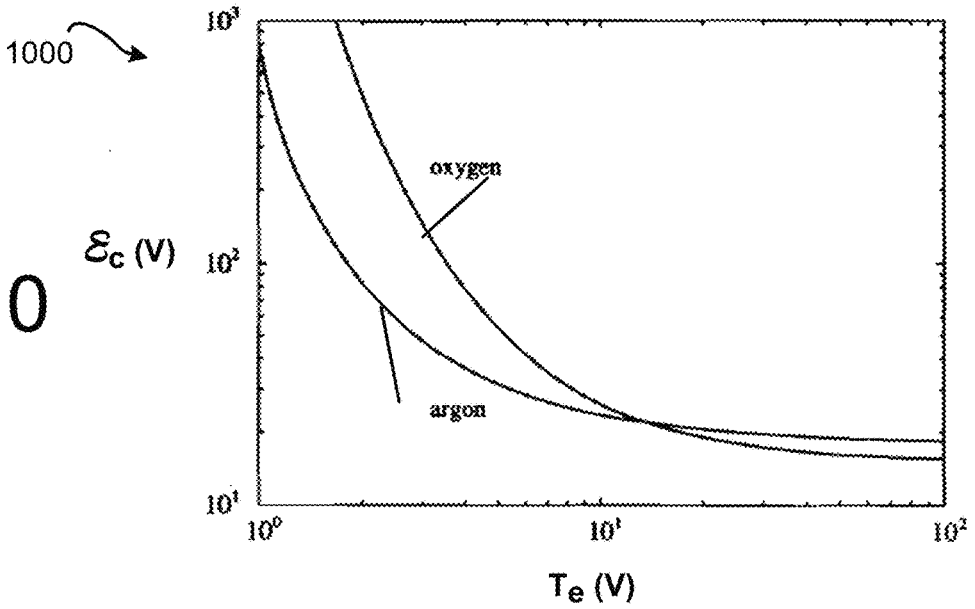

FIG. 19
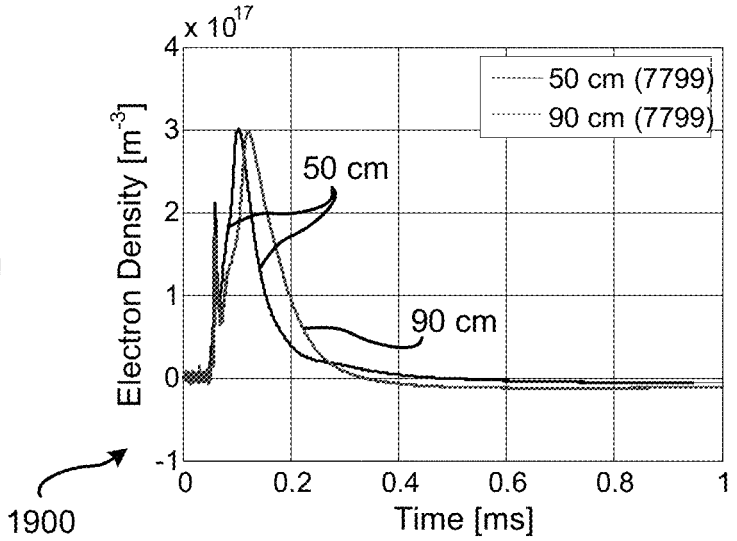
FIG. 20
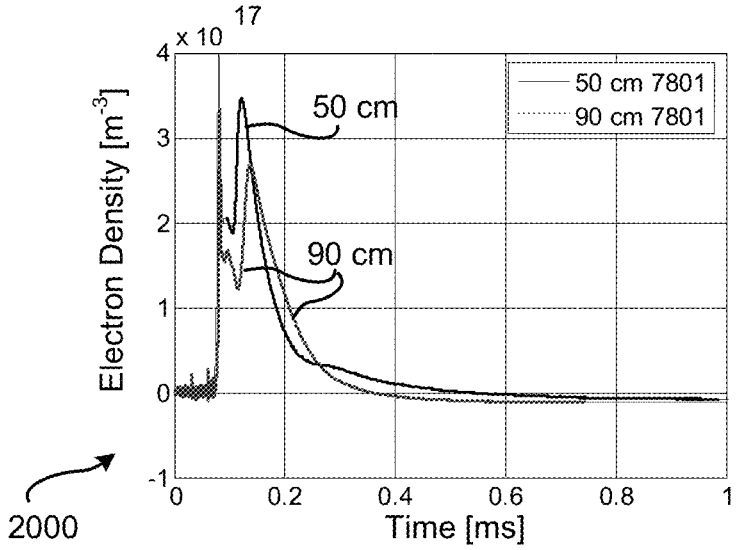
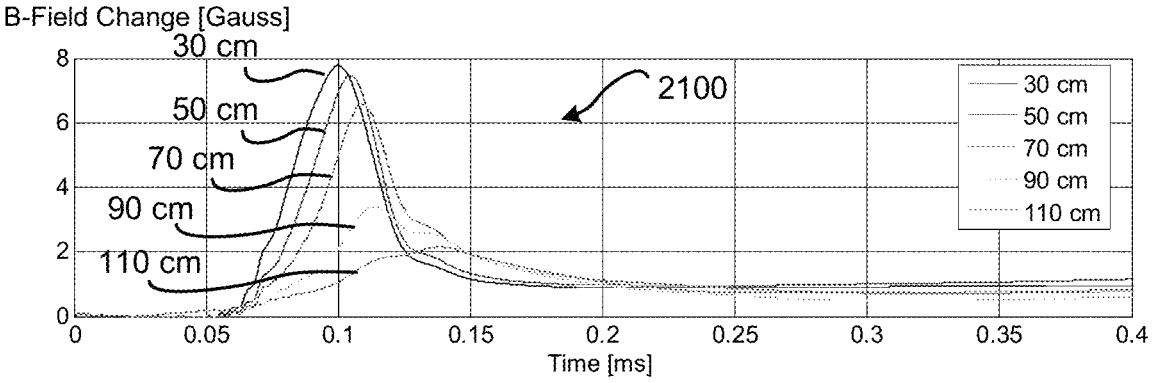
FIG. 21

APPARATUS, SYSTEMS AND METHODS FOR ESTABLISHING PLASMA AND USING PLASMA IN A ROTATING MAGNETIC FIELD

PRIORITY CLAIM

This application is a Continuation application of U.S. application Ser. No. 13/206,381, filed Aug. 9, 2011, and entitled "APPARATUS, SYSTEMS AND METHODS FOR ESTABLISHING PLASMA AND USING PLASMA IN A ROTATING MAGNETIC FIELD," which claims the benefit of and priority to U.S. utility application entitled "Rotating Magnetic Field Thruster", having application Ser. No. 61/372,001, filed Aug. 9, 2010, both of which are incorporated herein by reference in their entirety.

BACKGROUND

Traditional chemical-based propulsion systems may be used to launch and maneuver space vehicles. However, such chemical-based propulsion systems are inherently limited by the amount of chemicals, or fuel, that is transported into space along with the vehicle. At some point during the operating life of the space vehicle, the fuel will become depleted and will thus render the space vehicle unusable.

Electric-based propulsion systems have been developed to address, in part, the limitations inherent in chemical-based propulsion systems. However, such electric-based propulsion systems have their own unique limitations. For example, a plasma-based electrostatic or electromagnetic propulsion system, such as a Hall Effect or an ion engine, must have a sufficient amount of rare and expensive high-molecular weight gas. Further, the maximum amount of electrical power that can be generated and/or stored onboard the space vehicle limits the amount of thrust that can be produced by such electric-based propulsion systems.

Accordingly, there is a need in the arts to provide a more efficient and effective propulsion system for space vehicles.

SUMMARY

Systems and methods of establishing and using plasma in a rotating magnetic field are disclosed. An exemplary embodiment is a plasma thruster method that establishes a first transverse magnetic field with respect to a system axis of a plasma propulsion system; establishes a second transverse magnetic field oriented orthogonally to the first transverse magnetic field, wherein the second transverse magnetic field is out of phase with the first transverse magnetic field; and establishes a magnetic field aligned with the system axis using a plurality of magnet elements oriented along the system axis. A plasma containment portion defines an interior region, wherein an interior region of a plasma containment portion accommodates a plasma that is established by a rotating magnetic field component that is cooperatively established by the first transverse magnetic field and the second transverse magnetic field, and wherein the plasma is accelerated out of the plasma containment portion by magnetic forces to generate a propulsion force.

BRIEF DESCRIPTION OF THE DRAWINGS

Preferred and alternative embodiments are described in detail below with reference to the following drawings:

FIG. 8 is an example control circuit 800, interchangeably referred to as a discharge circuit, that is configured to manage formation and the subsequent acceleration of the magnetized plasma;

FIG. 9 conceptually illustrates the internal forces on an RMF plasmoid;

FIG. 10 is a plot illustrating total energy losses during ionization as a function of electron temperature;

FIGS. 19 and 20 are plots illustrating test results for two cases;

FIG. 21 is a plot illustrating a propagating FRC at various axial locations along an exemplary embodiment of the rotating magnetic field thruster;

DETAILED DESCRIPTION

Figure 1:
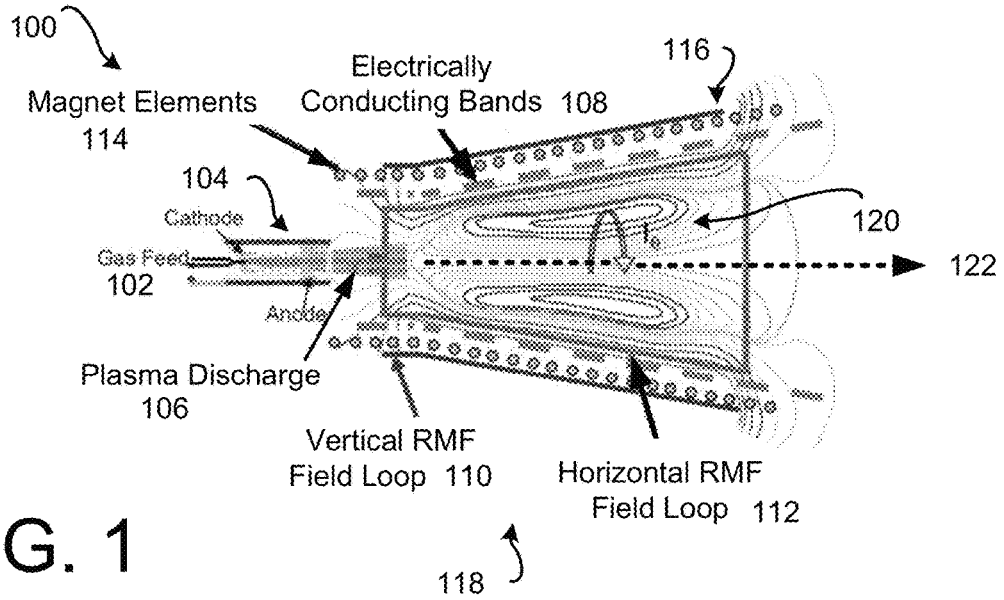
FIG. 1 is a diagram of an embodiment of a rotating magnetic field thruster.

FIG. 1 is a diagram of an example embodiment of a rotating magnetic field thruster 100. Embodiments of the rotating magnetic field thruster 100 have clear advantages for in-space propulsion, ranging from station keeping to orbital transfer missions, with significantly enhanced payloads due to high specific impulse. The exemplary rotating magnetic field thruster 100 comprises a gas feed portion 102, a plasma initiator portion 104 with a cathode and an anode, a plasma discharge portion 106, one or more electrically conducting bands 108, one or more vertical rotating magnetic field (RMF) field loops 110, one or more horizontal RFM field loops 112, one or more magnetic elements 114, and an exhaust portion 116. The above described elements 110-116 cooperatively define a plasma containment portion 118. The plasma containment portion 118 defines an interior region. The interior region of the plasma containment portion accommodates a plasma 120 that is established by a rotating magnetic field component that is cooperatively established by the first transverse magnetic field and the second transverse magnetic field.

In an example embodiment, the electrically conducting bands 110 may be configured as a plurality of flux conserving rings or the like. Alternatively, or additionally, the magnet elements 114 may be configured as solenoid coils or the like. In some embodiments, a thin passive magnetic flux expander/radiator may be located downstream of the plasma containment portion 118 or near the end of the plasma containment portion 118. Alternative embodiments of the rotating magnetic field thruster 100 may contain fewer elements than shown in FIG. 1, and/or may contain other elements not shown in FIG. 1.

The embodiments of the rotating magnetic field thruster 100, interchangeably referred to as an Electrodeless Lorentz Force (ELF) thruster, create from a high-density propellant, a magnetized plasma 120 [interchangeably referred to as a Field Reversed Configuration (FRC)] within the plasma containment portion 118. The magnetized plasma 120 is established using a rotating magnetic field (RMF). The rotating magnetic field creates the high-density magnetized plasma 120 utilizing an electrodeless Rotating Magnetic Field (RMF) formation. The RMF field produces an azimuthal current in the plasma, and when coupled with a magnetic field gradient, results in a $J_\theta \times B_r$ force that accelerates the magnetized plasma 120 propellant to high velocity. The rotating magnetic field is transverse to the thruster system (a longitudinal axis a122 of symmetry in the r-θ plane). By utilizing pulsed, high-density plasma formation within a magnetic field, embodiments efficiently ionize and eject the magnetized plasma 120.

The synchronous motion of the electrons magnetized in this magnetic field produce a large azimuthal current, that when driven in a direction opposite to that flowing in the external solenoid, reduces and eventually reverses the magnetic field inside the magnetized plasma 120, thereby forming a closed magnetic field configuration separate from the external thruster fields (the FRC). These large FRC plasma currents together with the greatly increased radial magnetic field created by the presence of the plasmoid result in a very substantial $J_\theta \times B_r$ force that rapidly accelerates the FRC propellant 120 out of the exhaust portion 116 of the rotating magnetic field thruster 100.

The rotating magnetic field thruster 100 is electrodeless so that the magnetized plasma 120 is magnetically isolated. Accordingly, thermal and chemical wall interactions are negligible. Since the magnetized plasma 120 is magnetically confined, high-temperature energetic particles remain isolated from the thruster walls, considerably increasing lifetime of the rotating magnetic field thruster 100 and minimizing wall conduction losses. This isolation of the magnetized plasma 120 also allows for efficient operation at high specific impulse, and allows operation with chemically reactive gases that contain oxygen or complex molecules such as monopropellants, in-situ resources, and/or ambient resources.

Embodiments of the rotating magnetic field thruster 100 provide a pulsed and highly efficient ionization source that is variable over a vast range of power, thrust, and Isp levels. The propellant 120 is completely isolated from the driving field so no complex magnetic detachment is required. A large azimuthal current (up to 20 kA) is generated with a radio frequency (RF) wave in the form of a steady transverse rotating magnetic field. The large azimuthal current is driven by rotating magnetic fields, rather than induced currents. The RF frequency is typically well under 1 MHz so that voltage and switching requirements can be met by modern solid-state switching. The axial forces are primarily driven by the driven $J_\theta$ and applied $B_r$ rather than thermal forces, thereby maximizing thrust efficiency.

Legacy electric-based propulsion (EP) systems have a dominant physical limitation. The primary energy loss mechanism for all fundamental electrostatic and electromagnetic propulsion devices and technologies is ionization loss. In realized EP systems, 100-500 eV/per atom is lost in the ionization process alone, not including kinetic energy transfer. All plasma-based electrostatic and electromagnetic propulsion systems require an ionized particle to be able to accelerate propellant. The tremendous ionization energy cost leads to several system-level tradeoffs that severely limit the operational range of electric propulsion devices. These legacy EP systems must operate with high molecular weight gasses and, as a result, high voltages and specific impulses are required to offset the energy debt incurred in the ionization process. Therefore, a thrust-to-power (T/P, optionally defined in mN/kW) and specific power [optionally defined in kW/kg] are fundamentally limited by the physics of the legacy EP device. There are two solutions for this problem provided by embodiments of the rotating magnetic field thruster 100: high-efficiency ionization and the acceleration of neutral (non-ionized) particles.

The rotating magnetic field thruster 100 has the capability to address the demanding combined requirements of high specific power, high efficiency, a large Isp range, and required T/P. Based on the current laboratory results, an exemplary embodiment of a rotating magnetic field thruster 100 would enable a range of high-power propulsion missions in the 10-100 kW class. This example rotating magnetic field thruster 100 has successfully demonstrated expected heating and acceleration of magnetized plasma toroids at both high efficiency and high velocity.

The rotating magnetic field thruster 100 entrains neutral particles in a FRC and add momentum through lossless charge-exchange collisions. Via this neutral entrainment process, a high-density FRC is formed and accelerated without incurring the large ionization energy loss. This high-density FRC then interacts with a slow moving neutral population and, instead of ionizing more gas, charge exchange collisions occur, exchanging the charge of a particle but no momentum. When this exchange occurs in an acceleration field, a slow moving charged particle is accelerated, while a fast-moving neutral particle leaves the device unhindered. Fundamentally, neutral entrainment utilizes the physical fact that the charge-exchange collision frequency is much greater than the ionization frequency. In this manner two (or more) particles can be accelerated with only one ionizing collision and excitation, drastically reducing total system ionization loss. Neutral entrainment is applicable to all high-density plasma devices, including Pulsed Inductive Thrusters.

Embodiments of the rotating magnetic field thruster 100 herald a new era of smaller, more efficient electric propulsion thrusters that could utilize cost-effective, readily available, propellants. In addition to radically improving performance of thrusters in traditional applications, embodiments using neutral entrainment would open the door to new high-power electric propulsion missions.

Embodiments of the rotating magnetic field thruster 100 that employ RMF-formed FRC propulsion have much lower ionization costs, and operate at higher plasma and energy density (reduced size and mass). Embodiments provide an advanced acceleration technique in an FRC device, neutral entrainment, which has the potential to dramatically reduce overall ionization losses by creating high-velocity neutrals through charge exchange. Neutral Entrainment Enables: truly variable specific impulse 500-5000 s, theoretical efficiencies near 100%, correspondingly high T/P>200 mN/kW, vast power ranges 10 kW-10 MW, and operation on lightweight propellants (e.g.: Air, water, AF315, hydrazine, etc.).

The inductive field reversed configuration employed by the various embodiments of the rotating magnetic field thruster 100 is now described. A field reversed plasma is simply a plasma that has large internal flowing currents. Those currents are large enough that they can generate magnetic fields that cancel out any applied magnetic field. This is effect can best be demonstrated in a planar geometry.

Figure 2:
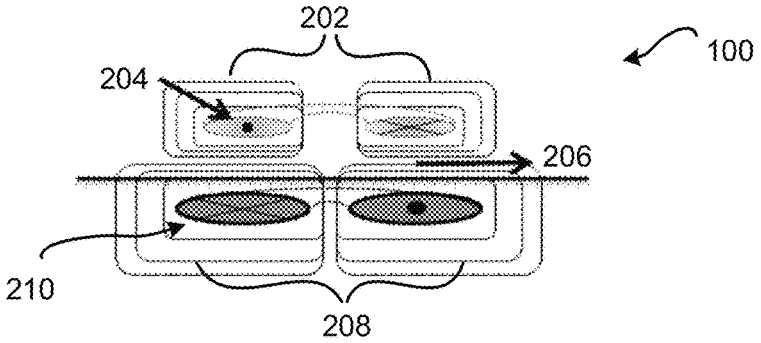
FIG. 2 shows a planar 'pancake' inductive coil that has a net, changing azimuthal current.

FIG. 2 shows a planar 'pancake' inductive coil 202 that has a net, changing azimuthal current 204. That current 204 induces an azimuthal electric field 206 which ionizes and induces a current 208 in a neutral gas 210. Equation 1 shows a simplified ohms law for azimuthal components.

$$\frac{-dB}{dt} = E_\theta = \eta j_\theta \quad 1)$$

In Equation 1B is the magnitude of the magnetic field in the direction of the system axis, $E_\theta$ is the induced electric field in the azimuthal direction, $\eta$ is the plasma bulk electrical resistivity, and $j_\theta$ is the azimuthal current density in the plasma.

When the azimuthal current generates a magnetic field large enough to oppose the coil field, it is called "reversed." This simply means that the applied field can no longer penetrate through the plasma magnetic field and into the plasma. It is important to note, that in this case there is a very strong magnetic pressure on the plasma current ring, from $J_\theta \times B_r$. In a cylindrical geometry, the above plasma is described simply as the Field Reversed Configuration (FRC).

Figure 3:
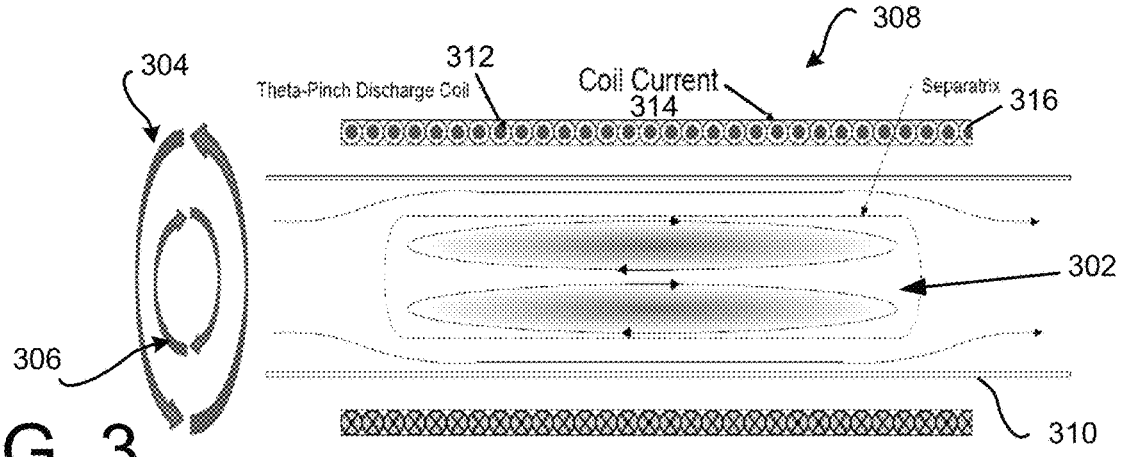
FIG. 3 is a schematic of an exemplary Field Reversed Configuration (FRC)

FIG. 3 is a schematic of an exemplary FRC. In this case, a current ring 304 generates a force that is primarily directed radially inward from both sides of the plasma 302, thus compressing the plasma 302. An FRC has another specific distinction from a simple current ring described so far. An initial magnetic field (in the opposite direction) fills the chamber before a discharge. A current ring 306 forms and begins imploding the initial magnetic field (and particularly the trapped flux), and prevents the current ring 304 from collapsing completely. This effect enhances coupling, maximizes trapped magnetic field, and dramatically increases the stability of the plasma.

As conceptually illustrated in FIG. 3, magnetized plasma 120, also referred to herein as a Field Reversed Configuration (FRC) plasmoid 302, consists of a closed field line, fully ionized plasma confined by a large azimuthal self current. This plasma diamagnetic current flows opposite to the coil currents producing the external axial magnetic field. In an example embodiment, magnetized plasma 120 is formed in a cylindrical coil 308 with a fast (<10 μs), and large (100's kA) pulsed inductive discharge resulting in a stable, well-confined plasmoid that is neutral to translation. For a thruster system, a simple conical coil 308 can then be employed to produce the magnetic gradient desired for rapid ejection of the magnetized plasma 120 for propulsion. In the thruster application, the steeper the coil pitch (field gradient) and the shorter the length of the cone, the faster and more rapid will be the magnetized plasma 120 acceleration and ejection. Typically this demands a very rapid and large flux change in order to generate a sufficiently large induced current. This method thus inherently requires a high voltage pulse power system for operation. As an aside, it can be noted that the pulsed inductive thruster can be thought of in this way as the limit where the cone angle reaches 90°. Fortuitously, there is another method for the generation of the magnetized plasma 120 that does not rely on high voltage inductive techniques. The same azimuthal currents can be caused to arise without the rapid magnetic flux change of pulsed induction by employing a Rotating Magnetic Field (RMF) where the rotating field lines lie in a plane transverse to the axis-122 in a cylindrical geometry.

In the various embodiments, when the internal fields balance the external fields, several very advantageous physical phenomena occur. First, the internal plasma 302, alternatively referred to as the FRC plasmoid, becomes completely detached from the external field. This allows the plasma 302 to either be worked on or translated by the coil 308 and limits any plasma interaction with the walls 310. Further, complex magnetic detachment of the magnetized propellant is not required. The non-limiting exemplary coil 308 is illustrated as having a theta-pinch portion 312, a coil current portion 314, and a separatrix portion 316. Other embodiments may have more than, or fewer than, the exemplary coil portions 312, 314, 316, and/or may use other nomenclature to identify the various portions of the coil 308.

Embodiments of the rotating magnetic field thruster 100 allow for a magnetic pressure balance to occur, where the magnetized radial plasma pressure balances the external applied magnetic field, as described in Equation 2, where $B_{ext}$ is the axial magnetic field external to the FRC radially, n is the plasma density, k is the Boltzmann constant, $\mu_0$ is the free space permeability constant, and T is the total plasma temperature.

$$P_0 = nkT = \frac{B_{ext}^2}{2\mu_0} \quad 2)$$

During operation, embodiments of the rotating magnetic field thruster 100 realize an additional unexpected significant advantage. As illustrated in the idealized magnetic fields in FIG. 3 the magnetic field is compressed between the conducting plasma and the conducting coil. This will further drive the plasma 302 from the walls 310 and act to amplify the effective magnetic fields.

Embodiments of the rotating magnetic field thruster 100 facilitate stability, radial, and axial pressure balances that become key parameters to design an FRC system. For propulsion applications, design parameters may be based on the last stage of the FRC formation process, referred to herein as translation. In a highly-compressed configuration, a FRC will begin to translate out of the discharge portion of coil 308 with a small non-uniform field or neutral density. This is typically accomplished with a small conical angle to the discharge portion of coil 308 providing a small J×B force on the plasma 302. However, as the FRC begins to leave the discharge portion of coil 308, it is acted upon by a strong magnetic pressure gradient that drives the FRC axially. This force is given in Equations 3 and 4, where $m_d$ is the magnetic moment of the plasma body.

$$F=Ma=\nabla(m_d \cdot B) \quad 3)$$

$$F_Z = m_d \frac{dB}{dz} \quad 4)$$

Figure 4:
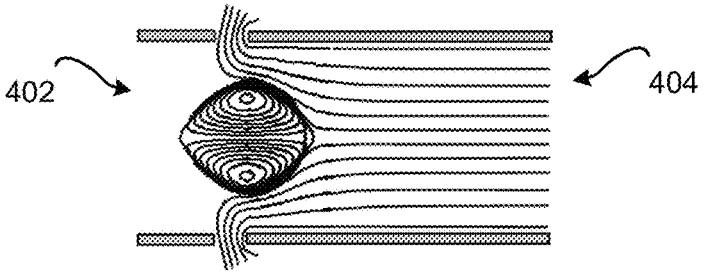
FIG. 4 illustrates an example FRC in a diverging magnetic field.

FIG. 4 illustrates an example FRC 402 in a diverging magnetic field 404. A greater detailed appreciation of the process can be realized by assuming a specific model for FRC shape, but it is also consistent with an energy argument for a high-β plasma. Equations 5 and 6 show a non-limiting predictive energy equation that does not require a priori knowledge of the FRC shape, rather its initial and final temperature conditions. These equations are based simply on the expansion of a high-β plasma from one temperature state to another assuming that the only net velocity (and therefore kinetic energy) is an axial one. N is the total particle inventory, $E_{BV}$ is the initial vacuum magnetic field energy, $V_z$ is the axial velocity, and $T_0$ is the final temperature.

$$E_{Tot} = \frac{5}{2}NkT + E_{BV} + \frac{1}{2}NM_0V_z^2 \quad 5)$$

$$\frac{1}{2}MV^2 = \frac{5}{2}Nk(T - T_0) \quad 6)$$

Propulsion application and issues of the various embodiments of the rotating magnetic field thruster 100 are now described in greater detail. First, the nature of a high-density, magnetized discharge lends itself to higher thrust, power, and plasma densities resulting in smaller thruster footprints and possibly smaller dry mass than a comparable-power electrostatic device. The inductive nature of the discharge provides an electrodeless environment that does not require neutralizer or life-limiting cathode and anode surfaces. Unlike legacy EP pulsed electromagnetic devices, the FRC generated by embodiments of the rotating magnetic field thruster 100 do not have plasma attached to the spacecraft (through coil field lines), and will have minimal divergence and spacecraft interaction issues. The pulsed and high electron temperature nature of the discharges immediately enables lower ionization losses due to excitation and recombination reactions. Also, the isolation of a compressed flux boundary limits wall-transport/interaction, decreasing ionization losses and enabling operation on complex and chemically-reactive propellants.

There are, however, a few concerns with plasma discharge in legacy EP systems (that are resolved by various embodiments of the rotating magnetic field thruster 100). First, a pulsed-inductive discharge of this nature requires very high voltages (on the order of 10's kV) in order to provide suitable breakdown and current drive in a large inductive load, possibly dramatically increasing dry mass in a power processing unit (PPU) and stored energy network. Secondly, the main acceleration mechanisms are driven by high particle pressure, with necessitation of high plasma temperature. And while a majority of those frozen flow losses will be recovered post ejection, the design and optimization of a system driver may be difficult, if not impossible. Finally, during fast FRC formation, a high-density sheath (possibly an order of magnitude greater than background density) forms at the separatrix. A high-mass propellant will increase radiative losses during formation, again adding complexity to the formation. Embodiments of the rotating magnetic field thruster 100 employ a Rotating Magnetic Field (RMF) FRC propulsion formation scheme that has the same benefits of the inductive discharge, but with lower voltage and plasma density during formation.

Figure 5:
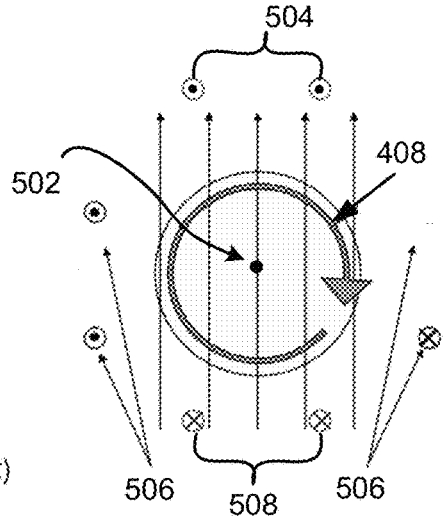
FIG. 5 illustrates a composite magnetic field that appears to be rotating perpendicular to an axis.

FIG. 5 illustrates formation of a rotating magnetic field, also referred to as a composite magnetic field, that appears to be rotating perpendicular to an axis 502 (extending outward from the page, and corresponding to the axis a122 of FIG. 1). In an exemplary embodiment, a Helmholtz coil pair 504 generates a uniform magnetic field perpendicular to the coil axis (transverse) as shown in black. A second, perpendicular coil pair 506 will also drive a transverse magnetic field, only perpendicular to the original pair (blue). If the two coils 504, 506 are driven with oscillating signals at substantially the same frequency, but out of phase, the composite magnetic field will be a rotating, transverse magnetic field. An exemplary embodiment employs oscilating sinusiodal signals that are 90° out of phase, though any suitable out of phase angle may be used. If an electron is magnetized to those field lines, it will be dragged and rotate azimuthally at the same frequency as the antennas. If the magnitude of $J_\theta$ is sufficient that an initial, axial bias is reversed, then the magnetized plasma 120 is formed. For an axially-distributed RMF system it is found that the azimuthal current may be described in accordance with Equation A.

$$J_\theta=en_e\omega r \quad a)$$

The large $J_\theta$ may be driven in a conical field with a radial magnetic field in a thruster system. The fully-reversed magnetized plasma 120 is then accelerated axially by the resultant $J_\theta \times B_r$ force. If the RMF antenna is also extended in the conical section, the azimuthal current continues to be generated as the magnetized plasma 120 moves downstream and the magnetized plasma 120 accelerates throughout the entire cone. Finally, as the magnetized plasma 120 expands through the conical section and beyond the exit of the cone the thermal energy of the magnetized plasma 120 is converted into axial velocity.

The magnetized plasma 120 formation is now described in greater detail. Magnetized plasma 120 formation utilizes a more advanced formation scheme to ionize and reverse a propellant. In an exemplary embodiment, the illustrated two Helmholtz-pair magnetic field coils 504, 506 form the antennas. Current in each antenna 504, 506 is varied sinusoidally to produce a transverse magnetic field 408 which rotates in the r-O plane, and which may be characterized in the form of Equation 7.

$$B_{RMF}=B_\omega\cos(\omega t)\hat{e}_r+B_\omega\sin(\omega t)\hat{e}_\theta \quad 7)$$

This creates a composite magnetic field 502 that appears to be rotating perpendicular to the axis, as illustrated in FIG. 5. The rotating magnetic field (RMF) antennas 504, 506 may be applied as a cylindrical tube to create an axial uniform, rotating magnetic field. An example embodiments employs two RMF saddle antennas constructed of copper Litz wire. Total antenna resistance may be less than 0.1 mΩ in an exemplary embodiment. The four flux conserving coils may be constructed of a single turn of 2 cm wide, 1.5 mm thick rectangular Litz in an exemplary embodiment. A multi-turn solenoidal winding provides for the bias field of 50-100 G, and is activated for each plasmoid pulse, with sufficient time to penetrate the Litz flux preserving/conserving straps. The RMF antenna fields are produced by a activating a simple closing switch allowing a high-efficiency pulsed capacitor to discharge and establish an oscillator/oscillation that is subsequently heavily damped by plasma load.

When an electron is magnetized, the magnetized electron is rotated with the field and forms a rotating $J_\theta$ current. The frequency of rotation is between the ion and electron cyclotron frequencies, $\Omega i<\omega<\Omega e$. Thus the electrons can be thought of as tied to the RMF field, and having the effect of driving the electrons in the direction of the RMF rotation while leaving the ions unaffected. As this electron rotates, it ionizes other particles creating a bulk, high energy current that is rotating azimuthally along the system axis 122.

As this magnetized plasma 120 drags bulk electrons azimuthally, a large current (on the order of tens of kA) is formed near the quartz boundary. If the generated current is more than the applied bias, a fully reversed configuration is formed. This then has a similar geometry to the inductively formed FRC described above, although it was not created with large pulsed currents, but rather RF oscillating currents and is dominated by the Hall term.

Figure 6:
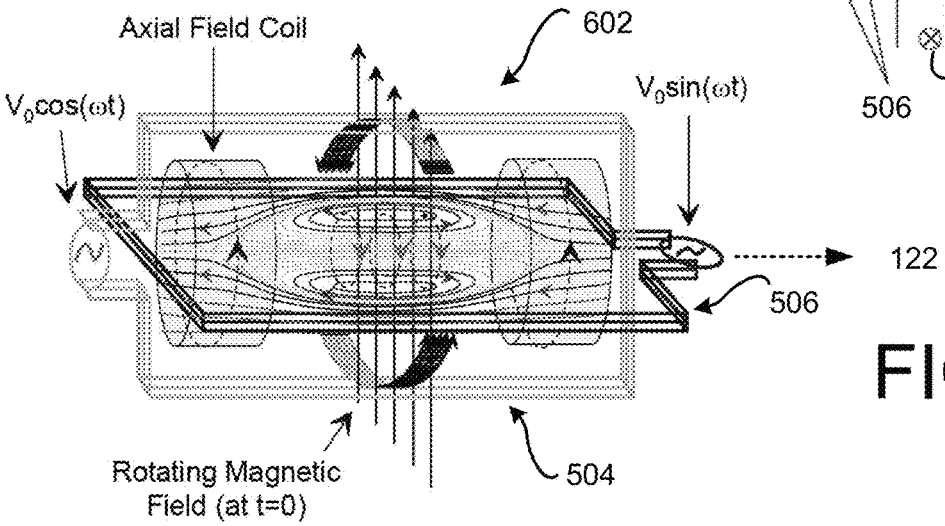
FIG. 6 is a perspective conceptual view of the resultant rotating magnetic field (RMF) field.

FIG. 6 is a perspective conceptual view of the resultant RMF field 602. In the case of the inductive plasmoid formation above, the internal currents are a complex function of plasma resistivity and coupling and are typically significantly less than the driving current. In plasmoid formation, ionization is typically 100% and drive current can be described simply as Equation 9.

$$J_\theta = e n_e \omega r \qquad 9)$$

Depending upon the embodiment and operation thereof, $J_\theta$ can be many times the magnitude of oscillating current.

In the various embodiments, three significant requirements are met with a fully reversed magnetized plasma 120. First, the induced Hall term, $J\times B/n_e$, must be sufficient to fully reverse the applied bias field. Second, RMF must penetrate the plasma, which sets an upper limit on plasma density, typically $\sim 10^{19}$ $m^{-3}$. And third, the electrons must be magnetized and free to rotate, but the ions must remain fixed ($\omega_{ce}>v_{ei}$).

An exemplary plasmoid formation may proceed as follows. a) A set of solenoidal windings create an axial bias magnetic field inside array of isolated conducting bands which preserve magnetic flux but permit transverse fields from RF antennas. Neutral gas fills chamber. b) An RF antenna produces oscillating transverse m=1 mode where electrons couple to the component rotating in the electron drift direction. A high density plasma of moderate pressure peaked on axis is produced. c) Newly created plasma electrons are strongly magnetized to RF field, and with the continuously increasing plasma density result in an ever larger synchronous electron motion (azimuthal current). Ohmic power flow dramatically increases plasma energy density (pressure). The high β plasma (diamagnetic) current opposes the initial axial magnetic flux. The flux conserving bands prohibit the initial coil flux from escaping thereby causing a large increase in the magnetic field external to the plasma as this field is compressed between the plasma and metal bands. (Lenz's law dictates that the plasma current be mirrored in the flux conserving bands thus enhancing the magnetic field even more). d) The magnitude of synchronous electron motion (i.e. current) driven by the rotating magnetic field reduces the magnitude of the axial magnetic field progressively inward radially toward the system axis. When sufficient synchronous current is attained, a point is reached where the axial magnetic field direction is reversed on the system axis to the field external to the plasma. At this point in time the plasma becomes wholly confined by the magnetic field produced by these plasma currents, and magnetically isolated from the magnetic field produced by the currents in the external coils and flux conserving bands. The result is a well confined, closed field plasmoid (FRC) in equilibrium with an external field now many times larger than the initial bias field, and a stable, fully formed magnetized plasma persists in the discharge region for as long as the RMF is maintained.

Figure 7:
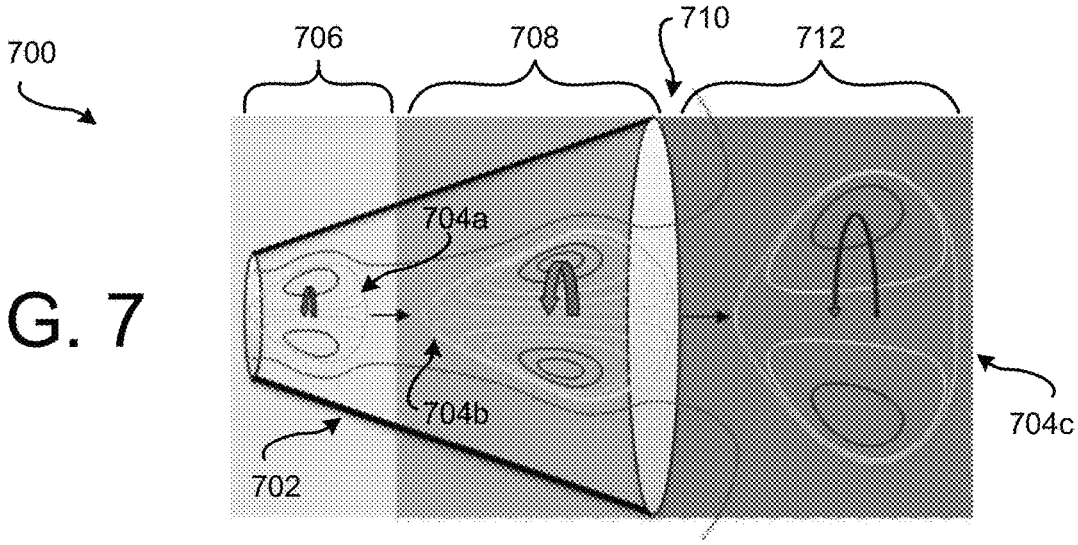
FIG. 7 illustrates an exemplary cylindrical RMF system of an embodiment of a rotating magnetic field thruster.

FIG. 7 illustrates a portion of a cylindrical RMF system 700 of an embodiment of an exemplary rotating magnetic field thruster 100. The exemplary cylindrical RMF system 700 generates an RMF-formed FRC that will accelerate and eject plasma. Further, a majority of its thermal energy will be recovered. However, the large internal $J_\theta$ generated by embodiments of the rotating magnetic field thruster 100 provide another acceleration mechanism. By adding a conical pitch to the discharge cone 702, the resultant radial magnetic field can be used for acceleration along the discharge cone 702. Further, the magnetized plasma 120 expands to maintain maximum coupling. In a non-limiting exemplary embodiment, the rotating magnetic field thruster 100 has a conical quartz cone with a conical bias field mapped along its perimeter. Any suitable structure and/or material may be used for the discharge cone 702 in alternative embodiments.

At startup, the RMF is applied along the axial region. In an exemplary embodiment, bias field windings, such as solenoidal windings, create an axial bias field $B_b$ inside array of isolated electrically conducting rings or bands. The process enters a helicon mode wherein the RF antenna produces oscillating transverse m=1 mode where electrons couple to the component rotating in the electron drift direction. A high density plasma of moderate pressure peaked on axis is produced. As conceptually illustrated in FIG. 7, a small, higher density plasmoid **704*a* is first formed at the small end of the discharge cone 702 (in an ionization formation stage 706 of the discharge cone 702). Electrons are strongly magnetized to steady field but only weakly couple to RF field ($B_\omega \ll B_b$). During a transition mode, appreciably increasing the $B_\omega$ magnetizes electrons in rotating RF field producing large synchronous electron motion (θ current). Ohmic power flow dramatically increases plasma β. The high β plasma compresses axial flux increasing the field external to the plasma. During a RMF mode, the increasing plasma density (with fully synchronous electron motion with the rotating $B_\omega$ field) produces very large azimuthal currents (10 s of kA) capable of completely reversing the axial magnetic field. Accordingly, a well confined, closed field plasmoid 704*a*** is generated.

Accordingly, the plasmoid **704*a* is then accelerated along the length of the discharge cone 702 due to direct acceleration. The plasmoid 704*b* is conceptually illustrated as increasing as it moves through the discharge cone 702 (in a direct $J_\theta \times B_t$ acceleration formation stage 708 of the discharge cone 702). At the exit 710, or exhaust, of the discharge cone 702 the plasmoid 704*b* is free to expand against the end magnetic field and both cools and further accelerates towards the end 706 of the discharge cone 702. The relatively larger plasmoid 704*c* exits the discharge cone 702 (in the illustrated magnetic expansion/acceleration stage 712). In reality, the operation of the rotating magnetic field thruster 100 is significantly more complicated, as the plasmoid both forms and accelerates during the entire length of the discharge cone 702**.

FIG. 8 is an example control circuit 800, interchangeably referred to as a discharge circuit, that is configured to manage formation and the subsequent acceleration of the magnetized plasma 120 (FIG. 1). The discharge circuit 800 uses several RF and pulsed power techniques and advanced generation solid-state switches. An exemplary embodiment employs metalized polyester film capacitors in parallel (12 per antenna) to provide the required antenna circulating power for each pulse. Exemplary capacitors have a circuit Q greater than 2000 and individual resistivity less than 3 mΩ per capacitor. These capacitors may be connected directly to 24 Voltage Controlled Solidtrons (VCS). The VCS switches are capable of handling large pulsed currents with very low on-state resistance. When coupled with a suitable reverse diode, the VCS switches provide for the continuance of the oscillating currents required for RMF generation with minimal energy losses. The VCS switch can be opened after ejection of the magnetized plasma 120 from the plasma containment portion 118, thereby recuperating some or even all magnetic energy back into the capacitors, thereby reducing energy losses. The entire switch-capacitor unit of the discharge circuit 800 may be installed in a shielded copper enclosure that aids in thermal management, EMI reduction, as well as forming a low-inductance current return (see FIG. 10). Any suitable conductive and/or metallic material may be used for alternative enclosures. Each capacitor-switch pair is mounted behind the Passive Aluminum Magnetic Field Expander/Radiator (PAMFER). In an exemplary embodiment, the control circuit 800 is controllably coupled to each of the plurality of magnetic coils, and sequentially pulse the plurality of magnetic coils to increase the magnetic field gradient along the system axis outward towards an exhaust of the plasma containment portion.

In some embodiments, each capacitor-switch pair may drive an individual Litz wire bundle of 200, 36-AWG, insulated wires that are operated in parallel to form a single, high Q LC oscillator for RMF generation. Exemplary circuit parameters are shown in FIG. 8. The rotating magnetic field thruster 100 can deliver energy into the magnetized plasma 120 at 1 J/pulse with an antenna voltage of roughly 200V. In an exemplary embodiment, the oscillator tank capacitors are charged directly from the bus. The discharge time for EMPT is roughly 15 μsec, with the remaining time between pulses used for Xenon gas refilling and capacitor recharging. At a 1 kHz pulse rate (1 kW input), the duty cycle is thus very low (1.5%), and the draw on a solar array or other power source is essentially constant. In some embodiments, a simple choke is used to isolate the bus and keep the solar array source voltage and current in a design range during the brief discharge period.

FIG. 9 conceptually illustrates the internal forces on an RMF plasmoid 902. FIG. 9 illustrates that increasing the cone angle (corresponding to vector 904) would increase the radial magnetic field and the acceleration force. However, if the cone angle increases faster than the FRC can expand, it will lose coupling with the wall and no longer accelerate through the entire discharge cone 702 (FIG. 7). In the various embodiments, a careful balance is maintained between cone angle and plasmoid velocity to maximize acceleration.

An important parameter for the rotating magnetic field thruster 100 is the thrust efficiency, which may be examined with an analysis of energy losses. For the ELF discharges, energy loss and deposition into kinetic energy can be determined. The analysis presented below assumes fully ionized, magnetized plasma which has a typical RMF density distribution and high-β configuration. A simple average radius, $r_s$ is used for plasma volume to simplify the equations below.

In the RMF acceleration stage 706 (FIG. 7), the force applied to the RMF is the $J_\theta \times B_r$, represented as Equation 9. The current density in a fully RMF discharge is represented as Equation 10. The magnetic field, $B_r$, is simply the radial component of the applied bias field. Therefore, the total current and total force can be found by integrating the volume of the cone in Equation 14. $L_a$ is the length of the accelerator and co is the RMF frequency.

$$f_z = j_\theta \times B_r \quad 9)$$

$$E_K = \int_0^{l_a} F_z \cdot x dx \quad 10)$$

$$j_\theta = e n_e \omega r \quad 11)$$

$$I_\theta = \iiint j_\theta dr d\theta dl \quad 12)$$

$$r_{plasma} \approx r_{separatrix} \quad 13)$$

$$I_\theta \approx \pi r_s^3 l_a e n_e \omega \quad 14)$$

$$B_r = B_{bias} \sin(\theta) \quad 15)$$

The total kinetic energy of the FRC is then the integral of the applied axial force over the length of the cone. It is important to note that the FRC remains highly coupled during this entire discharge (high magnetic pressure) and an average radius for the extent of the plasma is given by $r_s$, the separatrix radius. Equation 17 shows the total kinetic energy imparted by the RMF.

$$F_z = \pi r_s^3 l_a e n_e \omega B_{bias} \sin(\theta) \quad 16)$$

$$E_{K_RMF} \approx B_{bias} n_e e \omega \pi r_s^3 l_a^2 \sin(\theta) \quad 17)$$

The kinetic energy imparted by the magnetic expansion section can be given by the following analysis. Equation 18 describes the energy imparted on an FRC that is balanced by magnetic pressure between two states, a high-temperature, high magnetic field, and a low temperature, low magnetic field regime. Clearly this approximation tends to break down at very low temperature (or zero field), but during the expansion process it is typically found that an FRC will shed a majority of its thermal energy moving into a low field region. η is given as the conversion efficiency (Equation 20). The magnetic pressure balance is given in Equation 20.

$$E_K = \frac{5}{2} nk(T - T_0) \quad 18)$$

$$\eta_e = \frac{T - T_0}{T} \quad 19)$$

$$nkT = \frac{B_{ext}^2}{2\mu_0} \quad 20)$$

Finally, using the separatrix radius at the exit of the cone (in this case taken as the average radius) gives the total kinetic energy imparted on the FRC on its exit, for various conversion efficiencies, $\eta_e$.

$$E_{K_Th} \approx \eta_e \left( \frac{B^2}{2\mu_0} \pi r_s^2 l_a \right) \quad 21)$$

Ionization losses in an RMF FRC are a complicated measurement and one that must be done for a complete thruster analysis. For this estimation, the ionization losses that have been measured in other, steady-state RMF experiments will be used. It is expected that the ELF will have lower ionization losses than other EP devices, due to the more transient nature of its discharge as described later. This ionization loss energy is the full energy required to get a neutral particle to the exit of the thruster and includes radiation, excitation, recombination, electron bombardment ionization, and wall energy losses. Therefore, given a per-ion ionization loss of 40 eV/ion, ionization losses are simply, as shown in Equation 22.

$$E_{ion} = \frac{m_{bit}}{M_0} * 40[\text{eV}] * e[\text{J/eV}] \quad 22)$$

$M_{bit}$ is the total propellant mass in the FRC and $M_0$ is the atomic mass of the propellant. Ohmic coil losses are taken to be the resistive losses in the capacitors (ESR), discharge coil ($R_{Coil}$), and transmission lines ($R_{circuit}$) over the discharge length. Bias capacitor bank and pre-ionization circuit are simply the energy utilized in the bias and pre-ionization discharge circuits during the discharge.

$$E_{\Omega}=\Delta\tau(ESR+R_{Coil}+R_{Circuit})I_{RMS}^2 \quad 23)$$

Using representative numbers from a 50 J ELF discharge, with a separatrix radius ~0.8r and measured density and mass bits, Table 1 can be compiled. The operating conditions for embodiments of the rotating magnetic field thruster 100 will be highly efficient.

TABLE 1

| Energy Location | Distribution |
|---|---|
| Kinetic - RMF Acceleration | 80% |
| Kinetic - Thermal Expansion | 15% |
| Thermal - Unrecovered | <2% |
| Frozen Flow - Ionization | <5% |
| Ohmic - Coils and Capacitors | 5% |
| Ohmic - Bias | <1% |
| Ohmic - PI | <1% |

With respect to ionization losses, embodiments of the rotating magnetic field thruster 100 accelerate charged particles by the application of electrostatic and electrodynamic (magnetic) forces. In order to accelerate a propellant, the propellant must be charged. In legacy EP systems, the propellant must undergo an ionizing collision event. Embodiments of the rotating magnetic field thruster 100 employ a novel system to propel the propellant.

FIG. 10 is a plot 1000 illustrating total energy losses during ionization as a function of electron temperature. The primary loss mechanism for all fundamental non-thermal electric propulsion devices and technologies is ionization loss. In an exemplary EP system, it may take 100-500 eV/per atom to take one neutral propellant particle and eject one ionized particle, not counting kinetic energy addition. Plasma-based electrostatic or electromagnetic propulsion systems require an ionized particle to be able to accelerate propellant. Fundamentally, the energy cost of an ionizing collision is quite small, on the order of 10-20 eV, which roughly corresponds with an accelerating voltage of 10-20V for 50% efficiency. However, such an assessment of the total energy required for ionization may not be entirely realistic for a variety of reasons. For example, in a real plasma, energy losses also include recombination, excitation (radiation), and polarization losses. These losses will tend to dominate the effect of the ionizing collision, specifically at low energies. FIG. 10 shows a compilation of energy loss mechanisms for an ideal plasma in argon and oxygen which have minimum energies of ~14 and ~16 eV/ion. One eV is $1.6*10^{-19}$ Joules. FIG. 10 illustrates that for electron temperatures below 50 eV, the minimum total ionization potential is much greater than 14-16 V.

Additionally, in a non-magnetized plasma the particles are free to collide with the wall thereby removing even more energy from the system. To directly compare with a Hall thruster, Xenon has an ionization potential of 12 V/ion and operates with an electron temperature of 1-5 eV. The total collision cross section data is expected that, at those electron temperatures, the minimum ionization energy (ignoring wall losses) is >100 eV/ion, based on the data in FIG. 10. In fact, the measured ionization energy in a Hall thruster typically optimizes to 150-200 eV/ion. Other electric propulsion devices can have even more dramatic losses.

For propulsion, the thruster efficiency can be summed as the kinetic energy divided by the total energy spent (or power in a given unit of time). Equation 24 shows the efficiency η as a function of propellant velocity, plasma temperature, and ionization energy.

$$\eta = \frac{E_K}{E_{Total}} = \frac{e_k}{e_k + e_{ion} + e_{thermal}} = \frac{1/2m_0v_e^2}{\frac{1}{2}m_0v_e^2 + e_{ion} + 2\gamma kT} \quad 24)$$

Figure 11:
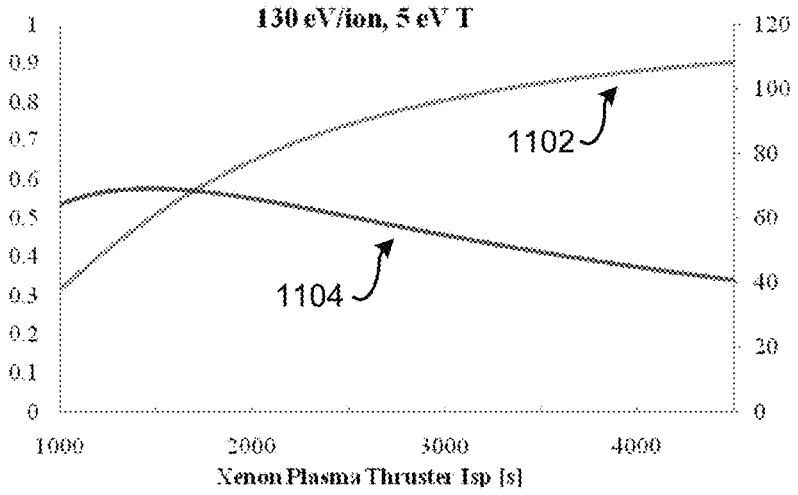
FIGS. 11-13 illustrate example theoretical maximum hall thruster ionization efficiencies and temperatures for various embodiments.
Figure 12:
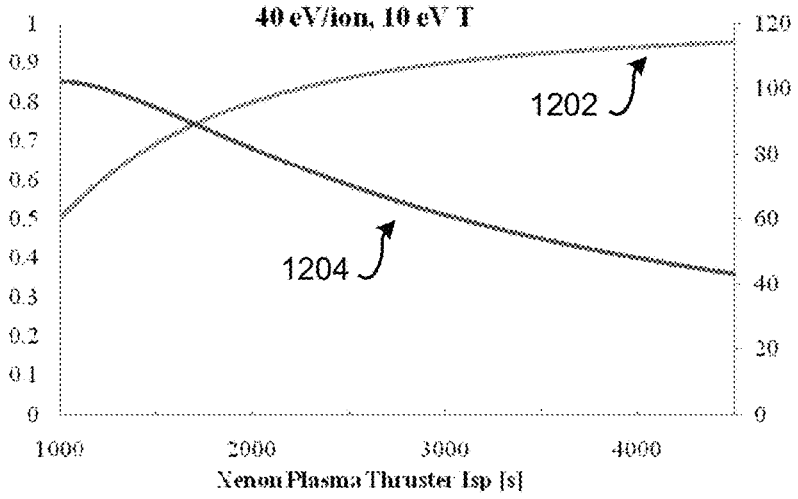
Figure 13:
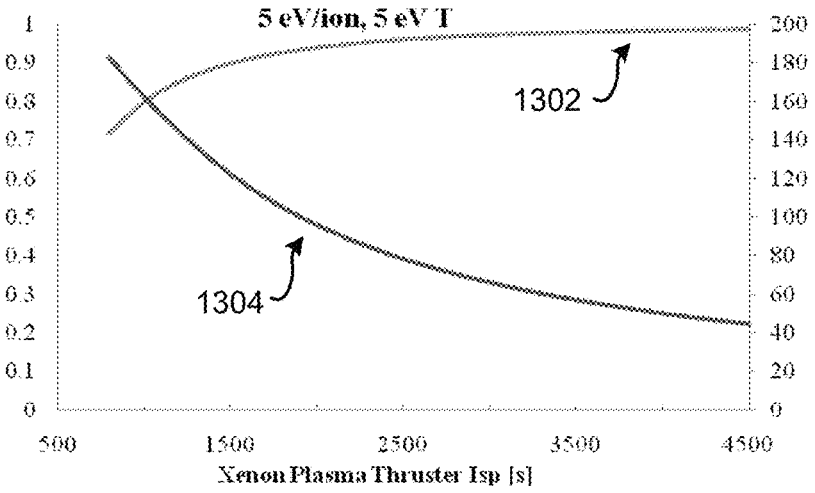

In accordance with equation 24, a maximum theoretical efficiency and thrust to power can be calculated for various thruster configurations. FIGS. 11-13 illustrate example theoretical maximum hall thruster ionization efficiencies and temperatures for various embodiments.

FIG. 11 illustrates the theoretical maximum propulsive efficiency for an example hall thruster ionization. Curve 1102 illustrates theoretical maximum efficiency (per unit) and curve 1104 illustrates the theoretical maximum thrust P (mN/kW).

FIG. 12 illustrates the theoretical maximum propulsive efficiency for an example RMF FRC thruster using Xenon. Curve 1202 illustrates theoretical maximum efficiency (per unit) and curve 1204 illustrates the theoretical maximum thrust P (mN/kW).

FIG. 13 illustrates the theoretical maximum propulsive efficiency for an example thruster with significant neutral entrainment (8 accelerated neutrals per ionization). Curve 1302 illustrates theoretical maximum efficiency (per unit) and curve 1304 illustrates the theoretical maximum thrust P (mN/kW).

Various embodiments of the rotating magnetic field thruster 100 employ neutral entrainment (NE). The fundamental concept in NE is that an FRC will ingest large quantities of neutral gas through charge exchange collisions, not ionization. If you accelerate an FRC while providing upstream neutral gas, Isp can be specified and mass/thrust added with very high efficiency. That is, accelerating an FRC into and through a large neutral gas population was beneficial to the FRC process. The plasma both gained mass and became more stable. Additionally, it is believed that only a fraction of the neutrals were ionized in the process, but most were swept up as the FRC passed. Accordingly, embodiments of the rotating magnetic field thruster 100 employ this discovery and apply it to a thruster environment for a space vehicle propulsion system.

Figure 14:
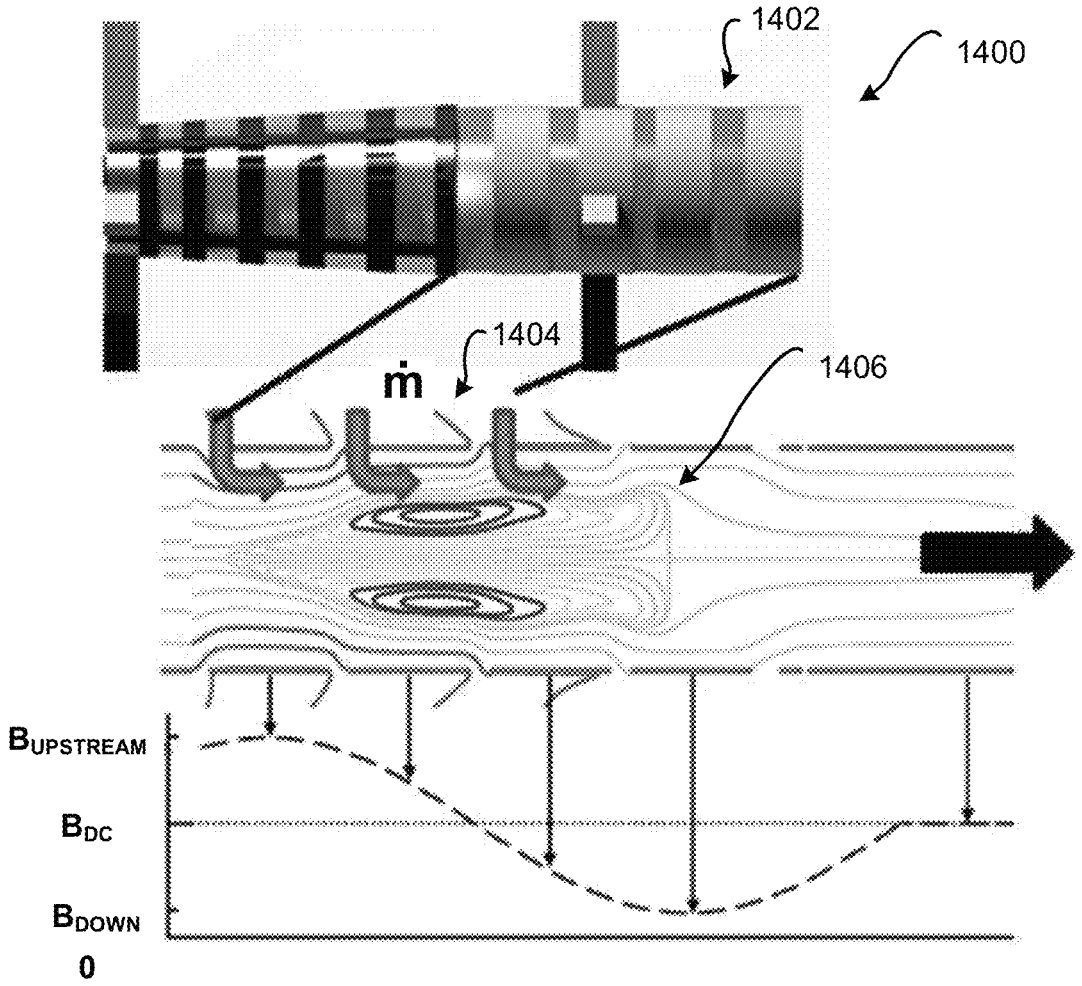
FIG. 14 illustrates an exemplary embodiment of a neutral entrainment ELF thruster.

FIG. 14 illustrates an exemplary embodiment of a neutral entrainment ELF thruster 1400. A portion 1402 of the neutral entrainment ELF thruster 1400 is configured with gas ports 1404 on a manifold or the like that are configured to receive gas as the propellant 1406 is moving through the rotating magnetic field thruster 100. Alternative embodiments may introduce gas through other types of manifolds, ports, or the like. In portion 1402, pulsed magnetic field coils are discharged such that an increasing magnetic gradient is formed in the direction of thrust. In this way both mass and energy can be added to the propellant stream (plasmoid). Shown in FIG. 14 is a magnetohydrodynamic simulation of a plasmoid being peristaltically accelerated by sequential field coils.

Neutral entrainment may be conceptually described as follows. A collisional, ionized propellant is accelerated in a gradient magnetic field, as in Equation 9. In this specific case, it will be in the form of a closed field, isolated FRC that is translating in a constant bias magnetic field. A slow, cold neutral gas population is introduced in front of the translating plasma. As the plasma ions collide with the neutral particles a positive ion will collide with an atom so as to capture a valence electron, resulting in a transfer of the electron from the atom to the ion. If this occurs between populations with the same mass, then the charge transfer occurs with no change in momentum. Additionally, kinetic energy is completely conserved. Equation 25 explains the neutral entrainment concept, where P is a propellant atom.

$$P^{+}(\text{Fast})+P(\text{Slow})\rightarrow P(\text{Fast})+P^{+}(\text{Slow}) \quad 25)$$

Also, the collisional cross section for charge exchange is given as Equation 26, where $v_a$ is the relative velocity and $\varepsilon_{ion}$ is the ionization potential.

$$\sigma_{CX}=\frac{1}{\varepsilon_{ion}}((1.58*10^{-7})-7.2*10^{-8}\ln v_a)^2 \quad 26)$$

Figure 15:
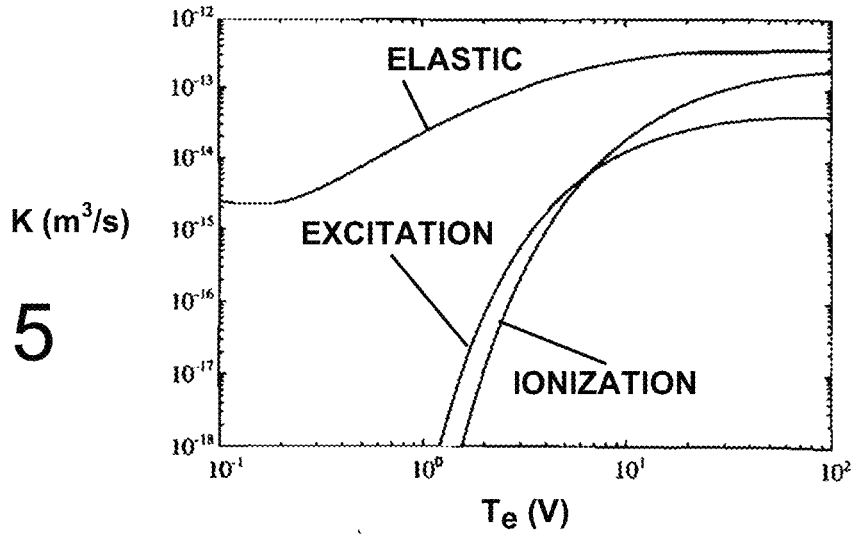
FIG. 15 illustrates exemplary collisional reaction rates.

After collision, the resulting fast moving neutral particle proceeds out of the rotating magnetic field thruster 100 unhindered by magnetic fields and simply adds momentum. Meanwhile, the slow-moving charged particle is still confined in an accelerating/gradient magnetic field, and is subsequently accelerated to high velocity and applying a thrust force to the spacecraft (via the magnetic field coils). In total there are two fast moving propellant particles, but only one ionization loss, thereby effectively reducing the total ionization loss per particle in half. Depending on the collision frequency, velocity, and density of the plasma and neutral populations of the propellant, this neutral entrainment process will be repeated throughout an FRC and possibly several times as shown in FIG. 15, which illustrates collisional reaction rates. In an exemplary embodiment, it is expected that there is a maximum of 8 neutral entrainments per particle possible with a typical NE geometry, thereby reducing ionization cost of 40 eV/ion to 5 eV/ion, well below even the theoretical minima.

The key parameter in neutral entrainment is the ratio of ionization to charge exchange collision cross section. FIG. 15 illustrates that the example charge exchange collisions (in this case shown as Elastic) are more likely than the ionization collisions. For the energies of interest charge exchange is 10 times as likely as ionization. Further, even if there is a 10% population of ionized propellant particles, they are accelerated with the propellant and are not considered to be a loss.

There are several key factors which are considered in order to optimize the entrainment of neutral particles in an accelerating field. The first factor is a high collision rate of propellant particles. In order to collide and entrain a neutral particle, the mean free path must be significantly less than the interaction region. This requires that there be sufficient plasma density as well as neutral density. A generalized ion-neutral mean free path is described in Equation 27, which shows the dependencies which will dominate an ion-neutral collision rate that is typically empirically obtained. V is velocity, Z is charge state, $T_i$ is ion temperature, u is atomic mass ratio, and $n_i$ is ion density.

$$\lambda_{Ion\text{-}n}=V/\nu_{i\text{-}n}\propto VZ^{-2}\mu^{1/2}n_i^{-1/2}n^{-1/2}T_i^{3/4}[m] \quad 27)$$

For this application density in accordance with Equation 27, $n_i$ and n must be large in order to interact on the scale of a rotating magnetic field thruster 100. Additionally, cold ions will be advantageous.

A second factor is a long acceleration region within the rotating magnetic field thruster 100. Equation 28 shows the requirements for accelerator length. Additional collision would be beneficial in allowing multiple neutral entrainment interactions.

$$L_A>\lambda_{Ion\text{-}n} \quad 28)$$

A third factor is the cross section of and interaction temperature within the rotating magnetic field thruster 100. Interaction temperature should be such that the charge-exchange collision cross section is larger than the ionization cross section, as shown in Equation 29. Equation 29 is applicable for the plasmas of interest.

$$\sigma_{charge_exchange}>>\sigma_{ionization} \quad 30)$$

A fourth factor are body forces and a quasi-neutral plasma. The acceleration mechanism is preferably such that there is no interaction with the collision rates and plasma density. Additionally, the plasma must be quasineutral. These two factors lead directly to body forces and an electrodeless operation. If there are large internal plasma sheaths, neutral entrainment may be compromised. Further, the ability to choose a propellant based on collision cross sections (and use molecular propellants) would add significant propulsive and performance benefits in some embodiments.

While most inductive and high density propulsion devices can be applicable to neutral entrainment, FRC plasmas substantially satisfy these factors. Additionally, an FRC can be formed and translated into a region of only neutrals and accelerating field, creating an optimal geometry for translation.

A detailed testing, characterization, and initial optimization of an exemplary rotating magnetic field thruster 100 has been completed. Investigations have been performed on Nitrogen, Air, Oxygen, and Xenon at numerous operating pressure and timings. Plasma discharges have been tested at 250 to 1000 V. Bias fields have been varied between 0 and 500 Gauss and the downstream drift tube has been operated from 0 to 200 Gauss. Discharge energies have varied from 10-70 Joules per pulse. Investigations in bias field shaping, FRC formation, and downstream translation/expansion have all been performed. Finally, a preliminary experimental performance study was done to investigate thrust impulse, specific impulse, and discharge energy utilization for Nitrogen discharges. The tested rotating magnetic field thruster 100 demonstrated non-inductive formation, acceleration, and ejection of a FRC plasmoid with a measurable thrust.

Figure 16:
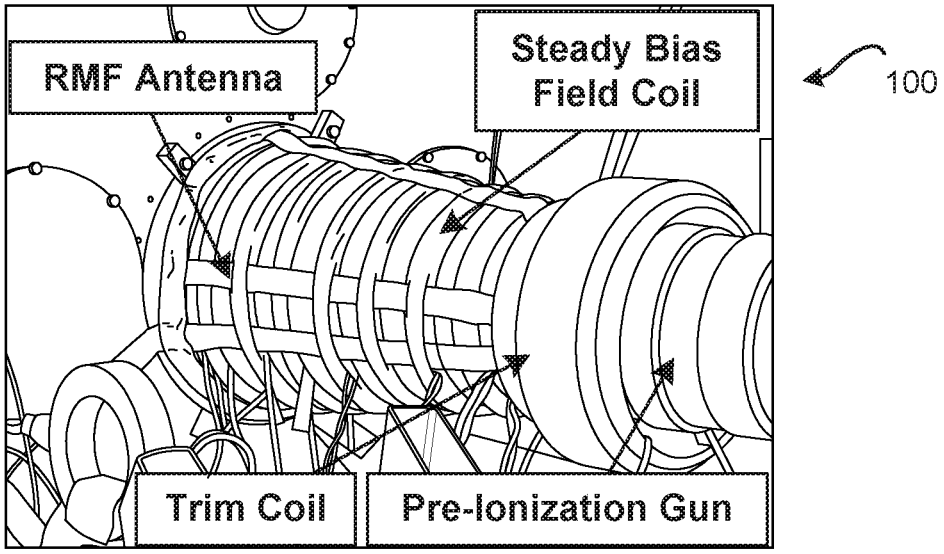
FIG. 16 is an annotated photograph of the tested rotating magnetic field thruster.

FIG. 16 is an annotated photograph of the tested exemplary rotating magnetic field thruster 100. The tested rotating magnetic field thruster 100 comprised a conical quartz chamber/insulator 5 mm in thickness, 420 mm long, and with a cone angle of 8 degrees. The tested rotating magnetic field thruster 100 is outfitted with nine solenoidal magnetic field coils and flux conserving loops to create a conical magnetic field structure. External to the slow-field bias coils are two RMF antennas consisting of insulated, 1-inch wide copper strap that are configured as annotated in FIG. 16. On the upstream end of the cone (small end) is the back plate, consisting of an FR-4 flange and feed-through for the pre-ionization discharge assembly and gas puff valve setup. Additionally a magnetic trim coil is added for complete variability in upstream field structure. This whole assembly is bolted to a large FR-4 flange that is connected to the drift chamber. An exemplary embodiment is an 80 cm-diameter, 1.5 meter length fused silica chamber. Alternative embodiments may use other materials for the chamber.

Figure 17:
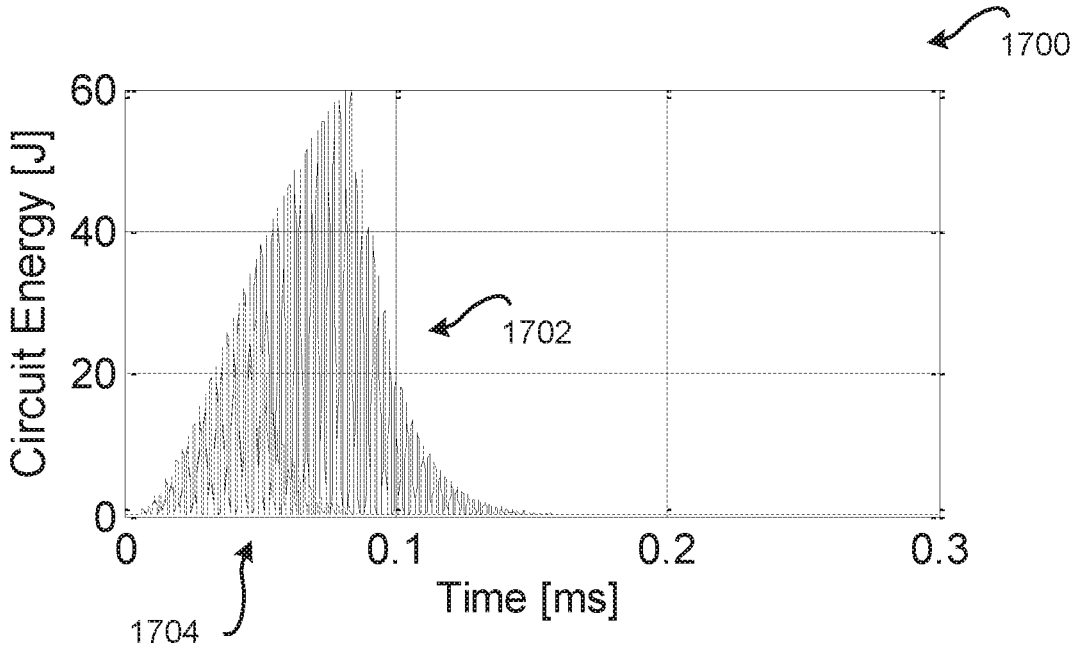
FIG. 17 is a plot illustrating a discharge from the tested rotating magnetic field thruster.

FIG. 17 is a plot 1700 illustrating a discharge from the tested rotating magnetic field thruster 100. The plot 1700 demonstrates performance using Nitrogen. The curve 1702 (shown in black) shows the antenna circulating energy (from capacitor voltage), oscillating at 250 kHz with no gas puff in the cone. It has a distinct rise as power is transferred to the antenna circuit (the secondary or load) from the capacitor and switching circuit (primary). The curve 1704 (shown in blue) shows identical operating parameters, but with gas and pre-ionization added. The initial power transfer to the circuit is identical in both cases, however, it can be clearly seen when the bulk ionization and current drive occurs (~50 μs). The circuit then loads and the current drive in the plasma is significantly increased. The change in current between a vacuum and plasma case shows the efficiency of coupling. ELF currently operates in the most efficient way possible, as soon as an FRC is formed the switches are opened and the FRC utilizes all stored magnetic energy and ejects from the discharge chamber. No residual energy or ohmic losses occur.

In an exemplary embodiment, axial magnetic field loops are arrayed externally along the discharge cone to measure the diamagnetic current drive in the cone. These measurements give an indication of the location of the separatrix and the amount of compression being done on the plasma. A compression ratio of 2 ($B_{external}/B_{initial}$ bias) is typical of a well-formed RMF FRC.

Figure 18:
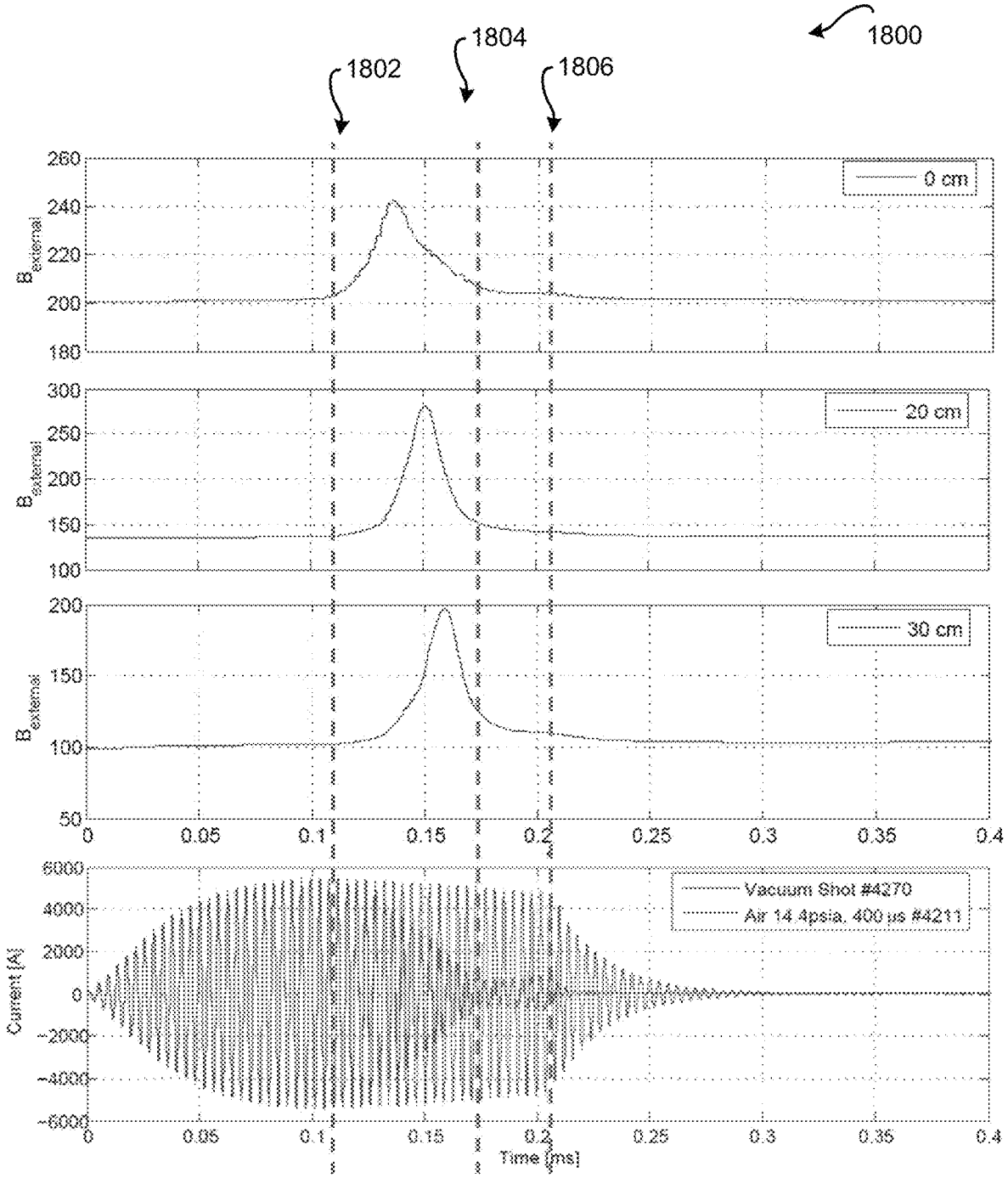
FIG. 18 is a composite plot illustrating exemplary response and formation of an FRC in the ELF of an exemplary rotating magnetic field thruster.

FIG. 18 is a composite plot 1800 illustrating exemplary response and formation of an FRC in the ELF of an exemplary rotating magnetic field thruster 100. As the loading begins and current drive is initiated in the RMF antennas, a spike in diamagnetic current is measured at the base of the cone, typical on the order of 10-50%. This current drive continues to progress axially down the cone, building in strength (ratio) and forming a well-defined leading edge. This implies that an FRC is both being formed axially and accelerated axially. FIG. 18 conceptually illustrates that the RMF FRC is being accelerated by electromagnetic forces during the RMF discharge. At temporal location 1802, the RMF antenna have maximum current and voltage, but no plasma. From location 1802-1804, the plasma loads and absorbs energy from the RMF system. From location 1804-1806, the FRC is ejected from the RMF discharge region and there is minor energy in the system. In this region 100, there is no propellant left in the discharge region. And finally the RMF circuit is opened and the oscillating current slowly decreases. Shown is a comparison of plasma 100 and vacuum discharge conditions 100. As conceptually illustrated in FIG. 18, when the bulk current and plasma is at the exit of the cone, there is little or no plasma at the small end of the cone.

Downstream magnetic field probes and Langmuir probes may be used to fully characterize the translating FRC. Time-of-flight measurements were done using the peak Langmuir probe data to extrapolate translation velocity. In an exemplary embodiment of the rotating magnetic field thruster 100, double Langmuir probes are utilized at two locations, Z=50 and 90 cm. By comparing the time arrival of plasma at 0 cm radius, an average velocity, peak plasma density, and peak impulse can be obtained.

Figure 29:
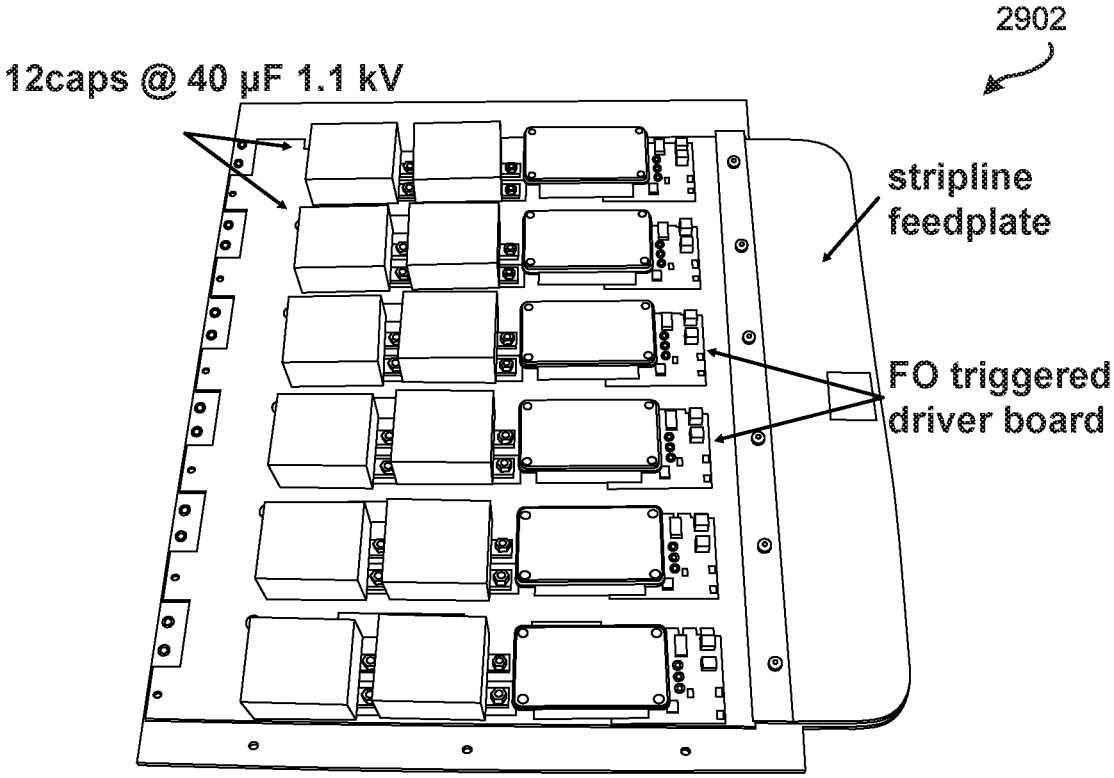
FIG. 29 is an annotated photograph of an exemplary driver board.

FIGS. 19 and 20 are plots, 1900 and 2000, respectively, illustrating test results for two cases, 1800 seconds and 3000 seconds specific impulse, respectively. Two fast-moving bulk FRCs can be seen in each chart. Additionally, a small very fast moving plasma front can be seen as the FRC pushes a small amount of low density gas in front of it. FIGS. 17 and 18 illustrate the electron density of the plasma at two downstream locations, 50 cm and 90 cm downstream of the ELF thruster along the main thruster axis. The FIGS. 29 and 20 show the plasmoid as it passes the probes and by comparing the time of arrival of the peak an average velocity can be obtained. These test results were generated by varying initial propellant density for a fixed discharge energy.

FIG. 21 is a plot 2100 illustrating a propagating FRC at various axial locations along an exemplary embodiment of the rotating magnetic field thruster 100. The external magnetic field probes disposed along the vacuum chamber can also be utilized as a generic time of flight (TOF) measurement in which probes at two separate locations can be compared to determine the average velocity of a flowing plasma. While the probes are farther away (R=40 cm) from the plasma, they are higher-sensitivity probes that provide a full view of the translating FRC. The external probe data may be used for confirmation of internal Langmuir probe time-of-flight. FIG. 21 illustrates the magnetic field on axis from 30-110 cm downstream of the ELF thruster. A high velocity plasma translates at least a meter downstream. Additionally, a significant diamagnetic signal is evidence of the lifetime of the FRC.

Radial scans of magnetic field and plasma density in an operating embodiment of a rotating magnetic field thruster 100 have been conducted. The key diagnostics in FRC propulsion are the downstream characterizations of the translating plasma. Radial profiles of plasma density and magnetic field uniquely show that, indeed, the downstream plasma is a reversed-field configuration plasma. By examining the radial profile at various axial locations a full characterization of the expansion and inner structure of the ejected plasmoid can be obtained.

Figure 22:
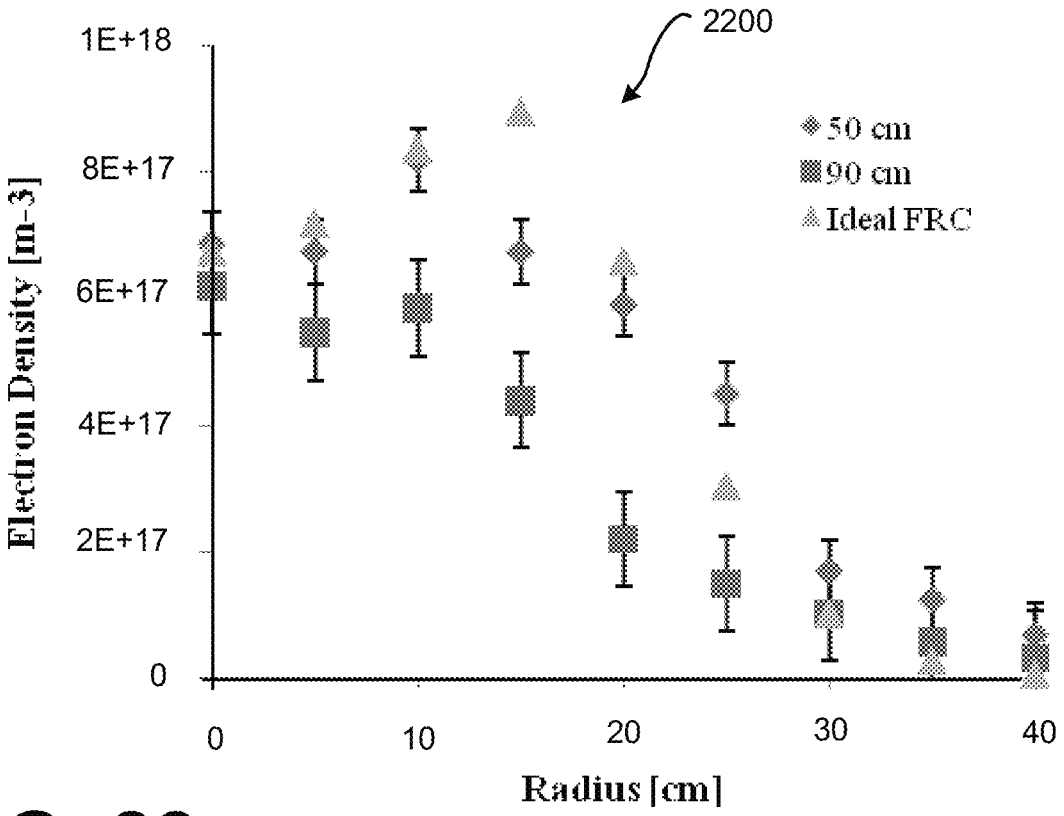
FIG. 22 is a plot illustrating radial density profile similarity to theoretical FRC.

FIG. 22 is a plot 2200 illustrating radial density profile similarity to theoretical FRC. FIG. 22 shows the peak radial plasma density for a 2100 second Isp translating FRC at two locations. The total energy and thruster for this discharge was 28 J and 0.75 mN-s. Shown are two axial locations and a scaled ideal FRC density profile, from a standard rigid-rotor model. The error bars shown correspond to statistical variations in density shot-to-shot rather than absolute Langmuir probe error.

Figure 23:
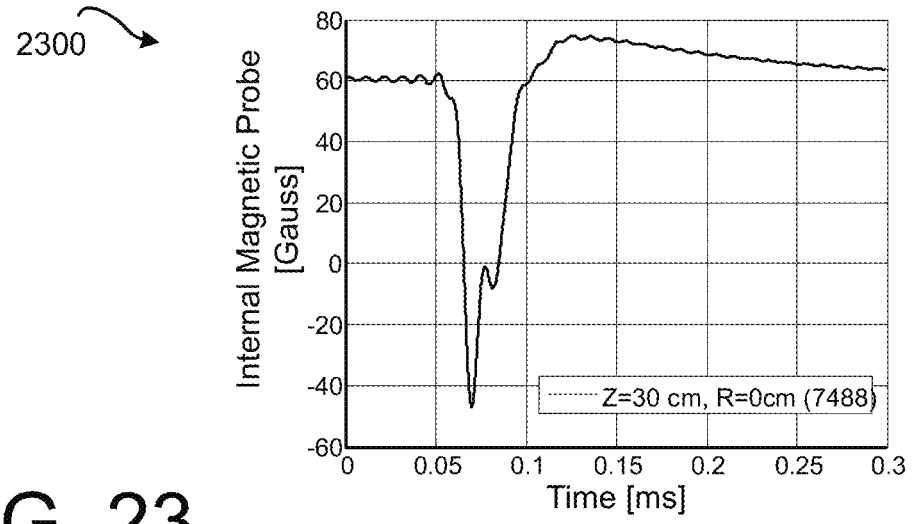
FIG. 23 is a plot of the internal magnetic field from a translating FRC passing over a high-speed magnetic field probe in an exemplary rotating magnetic field thruster.

FIG. 23 is a plot 2300 of the internal magnetic field from a translating FRC passing over a high-speed magnetic field probe in an exemplary rotating magnetic field thruster 100. Data is taken on axis. The data illustrates a magnetic field reversal as the FRC translates through the probe. Further, the strong reversal shown (80%+) is evidence of a highly coherent FRC.

Figure 24:
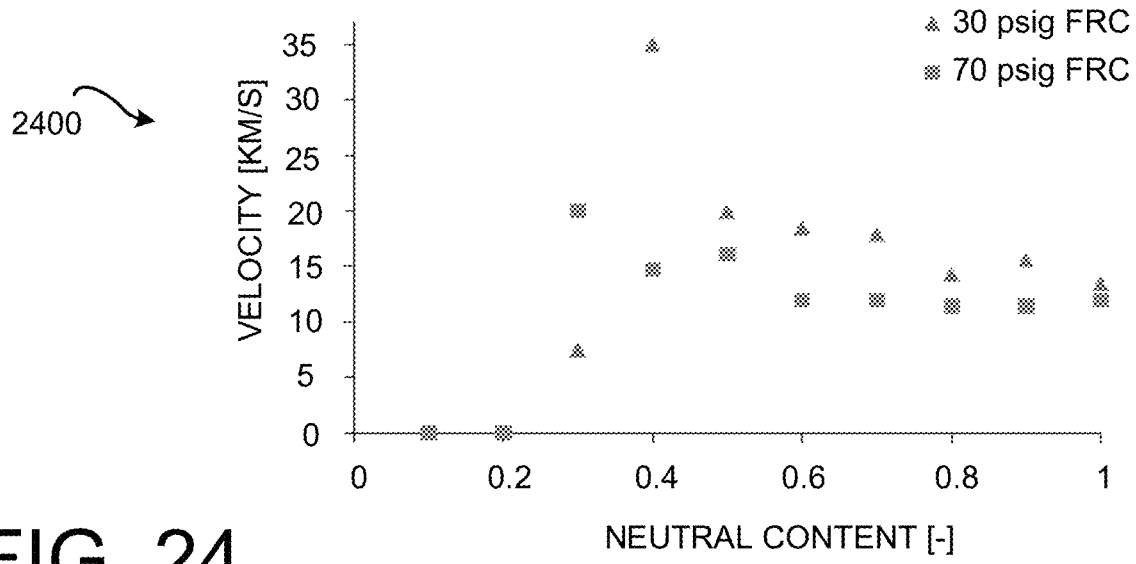
FIG. 24 is a plot illustrating the resultant velocity for a high-velocity, coherent FRC.
Figure 25:
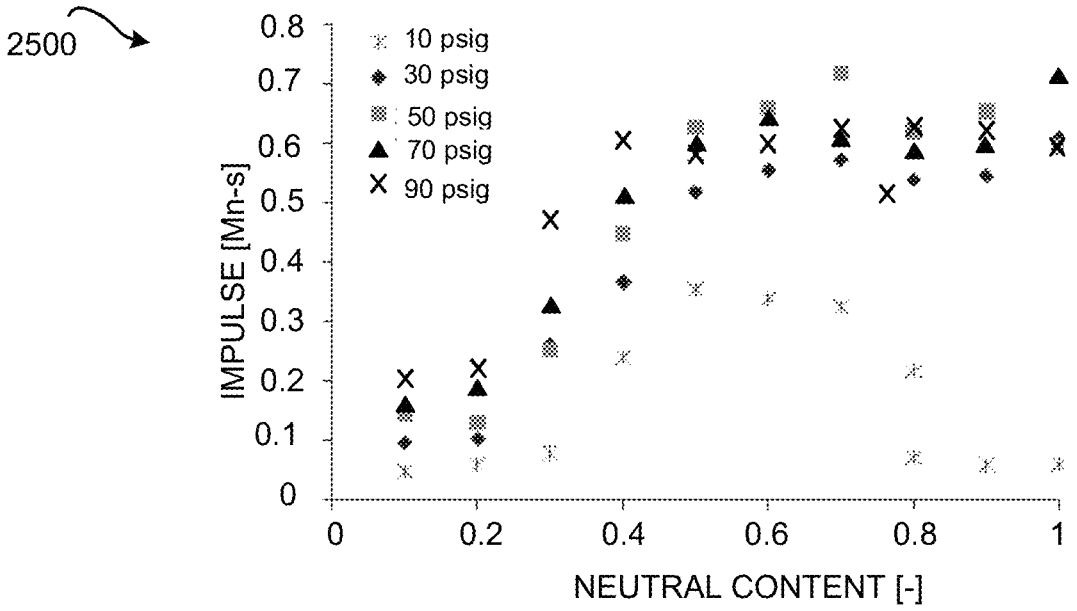
FIG. 25 is a plot detailing the total FRC impulse measured by a ballistic pendulum.

FIG. 24 is a plot 2400 illustrating the resultant velocity for a high-velocity, coherent FRC measured at 50 and 90 cm, downstream of a tested rotating magnetic field thruster 100. Neutral content is varied by both neutral puff pressure and valve timing prior to discharge. FIG. 25 is a plot 2500 detailing the total FRC impulse measured by the ballistic pendulum for the same variation in neutral content at various gas pressurization and valve timings. Functionally, as can be shown by neutral modeling, this is a variation in the neutral density profile at the time of discharge. Higher pressure yields a sharper neutral profile with higher density in the small end of the cone and a higher average neutral particle content. Results vary by magnetic field operating condition and propellant choice, however, the same general trends are expected and have been observed. At low neutral content there is not sufficient plasma content to drive significant azimuthal currents. Little diamagnetic current is produced, no significant electromagnetic acceleration occurs, and only thermal acceleration is observed. At the highest neutral content the plasma is 100% ionized and bulk FRC ejection occurs. However, a majority of ELF energy is spent ionizing and heating gas, rather than adding kinetic energy.

Additionally, and as indicated by Equation 17 above, when neutral density is high, the kinetic energy addition to the plasma is linear. As expected, impulse remains high, but velocity drops as $V \propto \sqrt{n}$ with increasing content. In the middle region there is sufficient plasma to drive large azimuthal currents, but additionally energy can be spent efficiently accelerating plasma to high velocities. FRCs formed in this region tend to also have much larger diamagnetic currents, high pressure, temperature, and velocity. Therefore, it is believed that FRC performance characteristics can be highly variable with only minor variations in neutral gas distribution and puff timing, but are relatively insensitive to changes in propellant type, magnetic geometry, etc.

Table 2 provides peak performance summary results for nitrogen, air, and for xenon, from a tested rotating magnetic field thruster 100. Velocity is measured with Langmuir and magnetic time-of-flight downstream. Error bars are large, +/−25% from average numbers shown above. Impulse measurements are from a ballistic pendulum, and are expected to be +/−10% from various calibrations performed. Energy usage estimates are taken from both measured capacitor energy and a detailed electrical circuit calculation using SPICE (Simulation Program with Integrated Circuit Emphasis) with an uncertainty <+/−5%.

TABLE 2

| Peak Performance Summary | |
|---|---|
| Nitrogen, Air | |
| Peak Velocity | 60 km/s |
| Peak Thrust | 1.0 mN-s |
| Peak Efficiency | 50% with 4000 s Isp and 0.74 mN-s Thrust |
| Xenon | |
| Peak Velocity | 100 km/s |
| Minimum Velocity | 8 km/s (E/M accelerated, coherent plasmoid) |
| Peak Thrust | 0.6 mN-s |

Figure 26A:
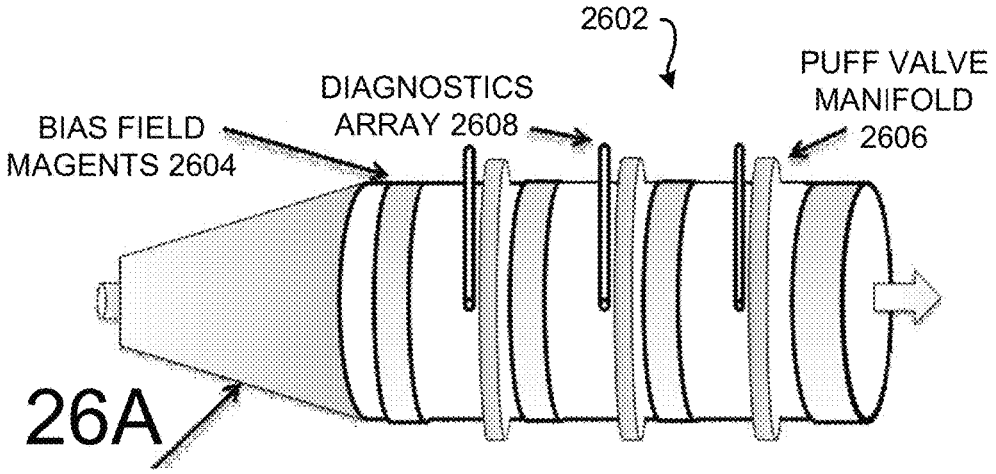
FIG. 26A illustrates an exemplary rotating magnetic field thruster fitted with a secondary drift tube and one or more bias field magnets.

FIG. 26A illustrates an exemplary rotating magnetic field thruster 100 fitted with a secondary drift tube 2602 and one or more bias field magnets 2604. The drift tube 2602 is configured to contain a low-level steady magnetic field and numerous high speed gas puff valves (Parker-Hannifin Valves, the same used in the thruster itself) in one or more puff valve manifolds 2606. An FRC will be ejected from ELF and transitioned into the drift chamber at a constant velocity. Utilizing the vast collection of existing diagnostics provided by an array 2608 of diagnostics devices, the FRC will be studied with and without a neutral gas present. Langmuir, Retarding Potential Analyzer (RPA), Fast Ion Gauge (FIG), and/or magnetic field probes may be utilized in the diagnostics array 2608 to fully monitor and diagnose the translating FRC. Using a ballistic pendulum, the total momentum can be determined. By directly comparing total momentum with the plasma momentum (from Langmuir and RPA probes) a neutral fraction and velocity can be determined. Additionally, initial and residual neutral densities in the drift chamber may be measured. Spectroscopic analysis may be used to estimate neutral and ion populations at various axial locations.

Figure 26B:
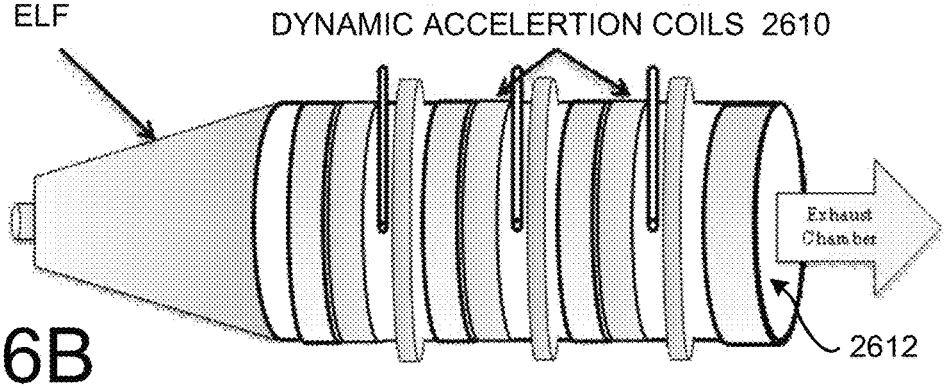
FIG. 26B illustrates an exemplary alternative embodiment of the rotating magnetic field thruster fitted with one or more dynamic acceleration coils.

FIG. 26B illustrates an exemplary alternative embodiment of the rotating magnetic field thruster 100 fitted with one or more dynamic acceleration coils 2610. For clarity, the exhaust chamber 2612 is illustrated.

Figure 27:
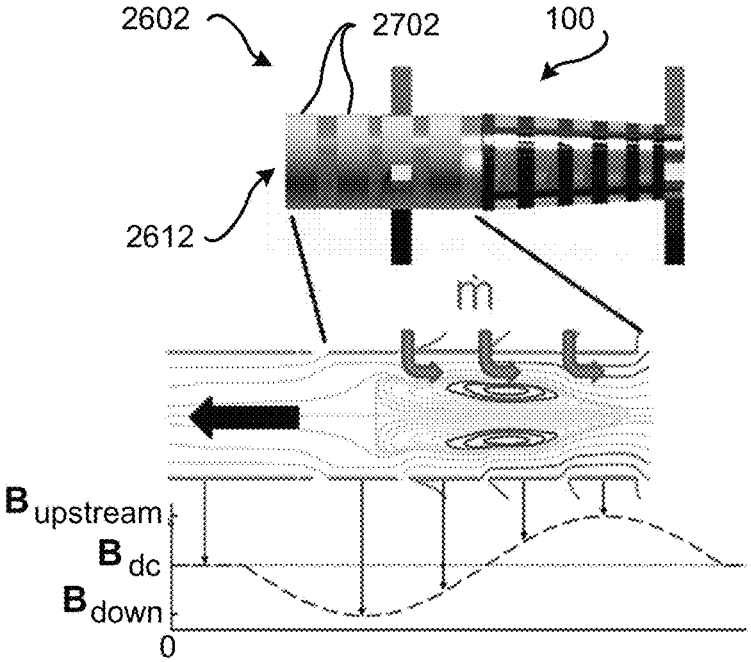
FIG. 27 shows an embodiment of the rotating magnetic field thruster 100 with dynamic acceleration coils added to the drift chamber.

FIG. 27 shows an embodiment of the rotating magnetic field thruster 100 with dynamic acceleration coils 2702 (shown as green bands for clarity) added to the drift chamber 2602. For the ELF thruster described earlier, a dynamic formation system was designed and constructed. The dynamic acceleration stage was designed as a secondary afterburner stage as an alternative embodiment addition to the RMF FRC system if sufficient velocity and kinetic energy could not be added to the RMF generated FRC. Testing revealed that it was not necessary to add the booster stage as Xenon FRC velocities greater than 10,000 seconds were measured utilizing the RMF system alone. The booster system may be utilized by alternative embodiments in a plasma environment.

Figure 28:
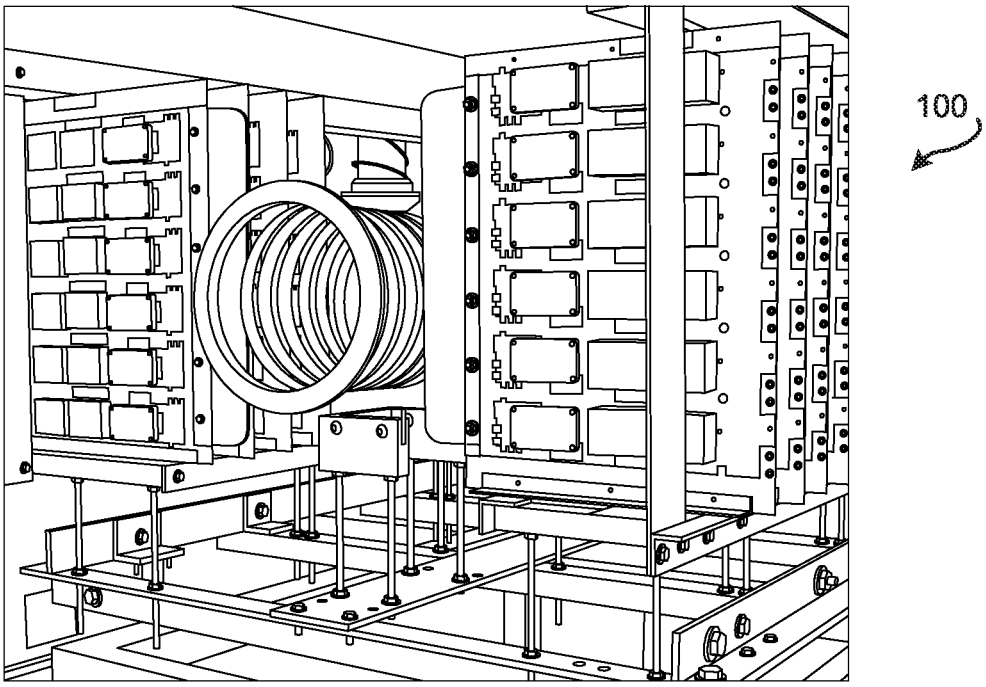
FIG. 28 is an annotated photograph of an embodiment of the ELF-based rotating magnetic field thruster 100.

FIG. 28 is an annotated photograph of an embodiment of the ELF-based rotating magnetic field thruster 100. FIG. 29 is an annotated photograph of an exemplary driver board 2902. The exemplary arrangement allows that addition of up to 1.1 kJ of kinetic energy to a single FRC (the elf thruster operates with 20-50 J of kinetic energy) with 8 solid-state driver boards 2902 (as shown in FIG. 29). Additionally, testing has been completed showing that these driver boards 2902 can be upgraded to a total of 5 kJ to enable any range of Neutral Entrainment, and at any gas density of interest.

As noted above, a novel ballistic pendulum was devised to measure thrust force of an magnetized plasma 120 exiting from the rotating magnetic field thruster 100. A ballistic pendulum setup consists of a stand, an optical displacement sensor, and the pendulum itself. The stand is a base and post with a metal plate on which the ballistic pendulum oscillates. A smaller second post is located just behind the ballistic pendulum and holds the eye of an optical displacement sensor in-place with a set screw. The optical displacement sensor may be powered with 12 VDC source to provide a linear, analog displacement signal. The ballistic pendulum face consists of a rigid nylon mesh covered with a quartz fiber paper. The purpose of the ballistic pendulum is to absorb the momentum of the magnetized plasma 120 and disperse the incident gas and any evaporated material uniformly in all directions. The paper and screen of the ballistic pendulum are attached to the pivot arm with flexible epoxy to reduce delamination. On the back of the screen a small reflective mirror is attached to provide the eye of the displacement sensor with an appropriate surface to detect. Top of the pivot arm is a block of metal attached via set screw (for height adjustment) and dual pivot point for stability.

The ballistic pendulum is covered with a woven quartz fiber paper that is key to the operation. A typical ballistic pendulum is designed to trap in incoming mass/particle that is incident. However, this is very difficult to do with a high-temperature, low-density plasma. The quartz filter acts to diffusively passivate and dissipate the incoming FRC. It consists of pure, woven, 400 μm quartz fiber filter that is designed to withstand 1100 degrees C. steady state with little sputtering or ablation. By neutralizing and deflecting the directed momentum of the gas diffusively, the collision can be considered inelastic with only axially transferred momentum.

The ballistic pendulum is calibrated in two ways. First, a simple steady-state calibration system is able to calibrate the pendulum in-situ between design and chamber-setup changes. The steady-state calibration is critical to maintaining the calibration of the optical sensor and the effective ballistic pendulum mass and lengths. However, a full impulse-calibration should also be completed in order to fully characterize the temporal response of the ballistic pendulum and verify that the expected inelastic response of the ballistic pendulum is maintained for various gas temperatures and velocities.

With the ability to form and sustain an FRC in gases such as Xenon creates the possibility of using the RMF produced FRC plasma as a source of EUV radiation. Xenon FRC plasmas have been generated at $10^{20}$ $m^{-3}$ peak densities at a plasma radius of 10 cm. To obtain sufficient radiant intensity, as well as the appropriate etendue for EUV lithography, the FRC plasmoid is compressed to a much smaller volume. This has been accomplished by forming the RMF FRC inside a set of coils as in the ELF thruster and compressing the FRC with the axial magnetic field coils outside the formation region as illustrated in FIG. 14. In this method of ELF operation however the coils are energized and timed to compress the FRC to high density. By proper timing and axial field profiling the FRC can be simultaneously compressed and translated. In this manner it can be positioned to be in an optimal location for light collection and relay. In the experiments, the timescale for the compression was roughly 1.5 μsec and resulted in an intense source of x-ray emission that persisted for the several microsecond lifetime of the FRC.

It should be emphasized that the above-described embodiments of the tested rotating magnetic field thruster 100 are merely possible examples of implementations of the invention. Many variations and modifications may be made to the above-described embodiments. All such modifications and variations are intended to be included herein within the scope of this disclosure and protected by the following claims.

The invention claimed is:

1. A plasma propulsion system, comprising:

a first plurality of magnetic field coils configured to receive a first oscillating current that produces a first transverse magnetic field with respect to a system axis of the plasma propulsion system;

a second plurality of magnetic field coils oriented orthogonally to the first plurality of magnetic field coils, and configured to receive a second oscillating current that produces a second transverse magnetic field, wherein the second oscillating current is out of phase with the first oscillating current;

a plurality of magnetic elements oriented along the system axis that produce another magnetic field aligned with the system axis;

a plasma containment portion defining an interior region, wherein the interior region of the plasma containment portion is configured to accommodate a plasma that is established by a rotating magnetic field component that is cooperatively established by the first oscillating current flowing through the first plurality of magnetic field coils and the second oscillating current flowing through the second plurality of magnetic field coils; and a manifold having a plurality of outlets along the plasma containment portion that introduces neutral gas particles into the interior region of the plasma containment portion, wherein the neutral gas particles undergo charge exchange collisions with particles of the plasma thereby increasing a number of particles magnetically accelerated per ionizing collision thereby reducing totally system energy loss to ionization, and wherein the plasma is accelerated out of the plasma containment portion by magnetic forces generated by the plurality of magnetic elements to generate a propulsion force.

2. The plasma propulsion system of claim 1, wherein the first plurality of magnetic field coils comprises a first magnetic field coil pair.

3. The plasma propulsion system of claim 1, wherein the first plurality of magnetic field coils comprises a first Helmholtz-pair magnetic field coil pair.

4. The plasma propulsion system of claim 1, wherein the first plurality of magnetic field coils comprises a first plurality of magnetic field coil pairs.

5. The plasma propulsion system of claim 1, wherein the plasma containment portion comprises: a cylindrical portion configured to receive a propellant mass, wherein the plasma is established from ionization of a portion of the propellant mass.

6. The plasma propulsion system of claim 1, wherein the plasma containment portion comprises: a discharge conical portion with an exhaust, and configured to exhaust accelerated propellant mass, wherein the discharge conical portion is defined by a first end with a first radius and a second end with a second radius larger than the first radius, and wherein the second end is an exhaust of the plasma containment portion.

7. The plasma propulsion system of claim 1, wherein the plasma is confined by electromagnetic forces generated by a first oscillating magnetic field and a second oscillating magnetic field.

8. The plasma propulsion system of claim 1, further comprising a plurality of closed electrical conductors oriented along the system axis, wherein the plurality of closed electrical conductors form a closed conducting path in a plane orthogonal to the system axis, and wherein the plurality of closed electrical conductors establishes a gradient magnetic field that accelerates the plasma towards a plasma containment portion exhaust.

9. The plasma propulsion system of claim 1, further comprising a plurality of magnets configured to establish a gradient magnetic field that accelerates the plasma towards a plasma containment portion exhaust.

10. The plasma propulsion system of claim 1, further comprising a plurality of flux conserving rings configured to establish a gradient magnetic field that accelerates the plasma towards a plasma containment portion exhaust.

11. The plasma propulsion system of claim 1, wherein the manifold that introduces the neutral gas particles into the interior region of the plasma containment portion facilitates collision between particles in the introduced gas and particles of the plasma to increase a mass of the plasma such that the propulsion force increases.

12. The plasma propulsion system of claim 1, wherein the plurality of magnet elements are configured to increase a magnetic field gradient along the system axis outward towards an exhaust of the plasma containment portion.

13. The plasma propulsion system of claim 1, wherein the plurality of magnet elements comprise:

a trim coil configured to increase a magnetic field gradient along the system axis outward towards an exhaust of the plasma containment portion.

14. The plasma propulsion system of claim 1, wherein the plurality of magnet elements comprise: a plurality of magnetic coils serially arranged over the plasma containment portion and along the system axis; and a control circuit controllably coupled to each of the plurality of magnetic coils, and configured to sequentially pulse the plurality of magnetic coils to increase a magnetic field gradient along the system axis outward towards an exhaust of the plasma containment portion.

15. A system, comprising:

a first plurality of magnetic field coils configured to receive a first oscillating current and produce a transverse magnetic field with respect to a longitudinal axis of the system;

a second plurality of magnetic field coils oriented orthogonally to the first magnetic field coil system, and configured to receive a second oscillating current that produces a second transverse magnetic field, wherein the second oscillating current is out of phase with the first oscillating current;

a plurality of magnet elements oriented along the longitudinal axis, and configured to produce a pulsed magnetic field aligned with the longitudinal axis;

a plasma containment portion defining an interior region, wherein the interior region of the plasma containment portion is configured to accommodate a plasma that is established by a rotating magnetic field component that is cooperatively established by the first oscillating current flowing through the first magnetic field coils and the second oscillating current flowing through the second magnetic field coils, wherein the plasma is compressed in the plasma containment portion by the pulsed magnetic field; and a manifold having a plurality of outlets along the plasma containment portion that introduces neutral gas particles into the interior region of the plasma containment portion, wherein the neutral gas particles undergo charge exchange collisions with particles of the plasma thereby increasing a number of particles magnetically accelerated per ionizing collision thereby reducing totally system energy loss to ionization.

16. The system of claim 15, further comprising: a plurality of electrical conductors oriented along the longitudinal axis, wherein the plurality of electrical conductors form a closed conducting path in a plane orthogonal to the longitudinal axis.

* * * * *